US010787835B2

(12) United States Patent
Kalish et al.

(10) Patent No.: US 10,787,835 B2
(45) Date of Patent: Sep. 29, 2020

(54) PLAY STRUCTURE TUBE CONNECTOR AND SYSTEM

(71) Applicant: Beach House Group Limited, Cheung Sha Wan, Kowloon (HK)

(72) Inventors: Lance Kalish, Dover Heights (AU); Pj Brice, Manhattan Beach, CA (US); Sachin Harneja, Dongguan (CN); Ido Leffler, Mill Valley, CA (US)

(73) Assignee: Beach House Group Limited, Kowloon (HK)

( * ) Notice: Subject to any disclaimer, the term of this patent is extended or adjusted under 35 U.S.C. 154(b) by 399 days.

(21) Appl. No.: 15/449,991

(22) Filed: Mar. 5, 2017

(65) Prior Publication Data

US 2018/0250606 A1 Sep. 6, 2018

(51) Int. Cl.

| | |
|---|---|
| ***A63H 33/00*** | (2006.01) |
| ***A63H 33/10*** | (2006.01) |
| ***E04H 15/00*** | (2006.01) |

(52) U.S. Cl.

CPC ..... *E04H 15/006* (2013.01); *A63H 33/008* (2013.01); *A63H 33/101* (2013.01); *A63H 33/108* (2013.01)

(58) Field of Classification Search

CPC .. A63H 33/008; A63H 33/101; A63H 33/108; E04H 15/006; F16B 7/00; F16B 7/042

See application file for complete search history.

(56) References Cited

U.S. PATENT DOCUMENTS

| | | | | |
|---|---|---|---|---|
| 3,176,428 A * | 4/1965 | Slingluff | A63H 33/108 446/107 |
| 3,469,339 A | 9/1969 | Thomas | |
| 3,648,404 A | 3/1972 | Ogsbury | |
| 4,078,328 A * | 3/1978 | Rayment | A63H 33/108 446/102 |
| 4,352,255 A | 10/1982 | Warehime | |
| 4,902,045 A | 2/1990 | McGugan et al. | |
| 4,903,942 A | 2/1990 | Licciardello et al. | |
| 4,927,287 A * | 5/1990 | Ohkawa | F16B 21/086 24/297 |

(Continued)

FOREIGN PATENT DOCUMENTS

WO 2012117697 A1 9/2012

OTHER PUBLICATIONS

International Search Report, PCT/US2018/026456, dated Jul. 16, 2018.

*Primary Examiner* — Eugene L Kim
*Assistant Examiner* — Alyssa M Hylinski
(74) *Attorney, Agent, or Firm* — Aaron Perez-Daple

(57) ABSTRACT

The invention is a tube connector for a play structure, and a play structure system that uses such tube connectors to connect a plurality of tubes together. The tube connector has a center portion and at least one projecting member extending from the center portion. To construct a play structure, tubes are fitted over the projecting members in the tube connectors. Flexing tabs on the projecting members, which are fixed at the end of the projecting member and extend back toward the center portion, lock into openings in the tubes to secure the tubes to the projecting members and connect the tubes together into a play structure.

20 Claims, 38 Drawing Sheets

(56) References Cited

U.S. PATENT DOCUMENTS 5,049,105 A * 9/1991 Glickman ..... A63H 33/06 446/107
5,144,780 A * 9/1992 Gieling ..... E04B 1/5831 135/114
5,199,919 A 4/1993 Glickman
5,318,470 A 6/1994 Denny
5,350,331 A 9/1994 Glickman
5,531,464 A * 7/1996 Maurer ..... B62B 3/00 211/126.15
5,769,681 A * 6/1998 Greenwood, Sr. ... A63H 33/062 446/120
5,791,026 A * 8/1998 Anscher ..... A44B 11/266 24/615
6,079,894 A * 6/2000 Obitts ..... A61H 3/02 135/75
6,413,004 B1 * 7/2002 Lin ..... B25B 7/02 403/171
7,316,598 B1 * 1/2008 Lock ..... A63H 33/102 446/126
7,341,391 B2 * 3/2008 Nakahori ..... F16B 7/0426 403/27
7,419,325 B2 9/2008 Rantrua
8,414,460 B2 * 4/2013 Todokoro ..... F16B 7/0446 482/23
8,708,765 B2 4/2014 Pope-Gusev
9,283,491 B2 3/2016 Pope-Gusev
2002/0064420 A1 * 5/2002 Lin ..... B25B 7/02 403/217
2002/0151248 A1 * 10/2002 Hsu ..... A63H 33/108 446/126
2003/0049992 A1 * 3/2003 Leemon ..... A63H 33/008 446/85
2003/0163897 A1 * 9/2003 Spinelli ..... B25G 1/04 16/110.1
2005/0097691 A1 * 5/2005 Tsuchiya ..... A47L 13/20 15/144.4
2006/0264147 A1 * 11/2006 Shoptaugh ..... A63H 33/042 446/120
2008/0078464 A1 4/2008 Lowe
2009/0176622 A1 * 7/2009 Pizmony ..... A63B 9/00 482/35
2009/0233516 A1 * 9/2009 Monge Rodriguez ..... A63H 33/101 446/120
2010/0037437 A1 * 2/2010 Buday ..... A44B 11/266 24/163 K
2010/0304935 A1 12/2010 Todokoro
2013/0195547 A1 * 8/2013 De Wilde ..... A63H 33/101 403/330
2015/0321111 A1 * 11/2015 Samlaska ..... A63H 33/106 446/124
2017/0362811 A1 * 12/2017 King, Jr. ..... F16B 12/10
2018/0209474 A1 * 7/2018 Klein ..... A63H 33/101

* cited by examiner

PLAY STRUCTURE TUBE CONNECTOR AND SYSTEM

BACKGROUND

1. Field of the Invention

The invention is in the area of play structures and the connectors used therein.

2. Description of the Related Art

Play structures and connectors used to assemble such structures are known in the art, as discussed below. However, the prior art does not disclose or suggest the advantageous features of the present invention, as discussed below.

U.S. Pat. Nos. 4,352,255 and 5,318,470, to Warehime and Denny respectively, disclose modular construction sets with tubes that are assembled together using various connectors. However, the connectors in these patents lack the physical structure of the inventive connector, including the flexing arms that lock into the tube. While the Warehime patent does show a slot in the tube, the slot does not engage with any element on the connector. Instead, it merely helps the tube end expand as the connector is inserted—i.e., it helps to maintain a good friction fit between the tube and the connector.

U.S. Pat. Nos. 8,708,765 and 9,283,491, both to Pope-Gusev, disclose various tube connectors. However, in U.S. Pat. No. 8,708,765, the connectors are garden-variety, friction fit connectors that differ significantly from the invention. In U.S. Pat. No. 9,283,491, the connectors are more complex, but still lack flexing arms which lock into apertures in the tube as in the invention.

U.S. Pat. No. 5,049,105 to Glickman discloses a hub connector for tubes in a toy construction set. In this connector, the male member flexes as it goes into the tube, and then locks against the internal structure of the tube. This connector has key differences versus the invention: first, the flexing here occurs at the leading edge of the male member, and the two sides of the male member are fixed toward the hub/center part of the connector. This is the exact opposite of the inventive connector's flexing structure, wherein the leading edge of the flexing tabs are fixed and the flexing ends of the tabs are toward the hub/center part of the connector. In other words, in the invention the tabs flex at the trailing edge and not the leading edge, as the tube is inserted over the male member. Moreover, in this patent the flexing elements do not lock into holes or apertures in the tube, as in the invention. Further, while the center of this patent's hub has a circular opening for a tube, the structure around the circular opening is very different from the structure in the inventive connector.

U.S. Pat. Nos. 5,199,919 and 5,350,331, also to Glickman, disclose construction toy systems wherein tubes of various lengths are used with connectors to build a structure. The connector in these systems has flexing arms with protrusions that lock into a circular groove on the tube, but its flexing arms lock onto the outside of the tube and not the inside as in the invention. In addition, as with the other Glickman patent discussed above, the flexing here occurs at the leading edge of the connector, and the two sides of the connector are fixed toward the hub/center part—which is the exact opposite of the inventive connector's flexing structure.

U.S. Pat. No. 3,648,404 to Ogsbury discloses a connector used in a toy building set. This connector has a radial, ball-shaped male member that is slotted, so the sides of the ball can flex toward each other when the male member is inserted into the tube. However, the radial member merely has a friction fit with the tube, and does not lock into holes or apertures in the tube as in the invention. And again, the flexing here occurs at the leading edge of the connector, and the two sides of the connector are fixed toward the hub/center part—which is the exact opposite of the inventive connector's flexing orientation.

U.S. Pat. No. 4,078,328 to Rayment discloses a connector similar to that in the Ogsbury patent discussed above, except that the base of the ball-shaped male member has a shoulder which engages the inside of the tube to restrict pivotal movement of the tube. Also, the end of the tube can have a slot therein, and the slot in the tube engages the base of the ball-shaped male member to lock the tube into a perpendicular orientation with the connector rather than a straight-on orientation. However, neither the shoulder engagement nor the slot engagement involves a flexing arm that locks into the tube as in the invention.

U.S. Pat. No. 3,469,339 to Thomas discloses interconnecting tubes, and the connectors have flexing arms that lock into apertures in the tubes. However, the flexing here occurs at the leading edge of the connector, and the two sides of the connector are fixed at the trailing edge. This is the exact opposite of the inventive connector's flexing structure, wherein the leading edge of the flexing tabs are fixed and the flexing ends of the tabs are at the trailing edge. Moreover, while the center of this patent's connector has a circular opening for a tube, the structure around the circular opening is different from the structure in the inventive connector.

U.S. Pat. No. 7,419,325 to Rantrua discloses a tube assembling device. While the connectors in this patent have flexing arms, those flexing arms do not lock into apertures in the tubes as in the inventive connector. As with the other patents discussed above, the flexing orientation here is also different than in the inventive connector, and other aspects of the physical structure differ as well.

SUMMARY OF THE INVENTION

The invention is a tube connector for a play structure, and a play structure system that uses such tube connectors to connect a plurality of tubes together. The tube connector has a center portion and at least one projecting member extending from the center portion. To construct a play structure, tubes are fitted over the projecting members in the tube connectors. Flexing tabs on the projecting members, which are fixed at the end of the projecting member and extend back toward the center portion, lock into openings in the tubes to secure the tubes to the projecting members and connect the tubes together into a play structure.

DETAILED DESCRIPTION OF THE INVENTION

Figure 1:
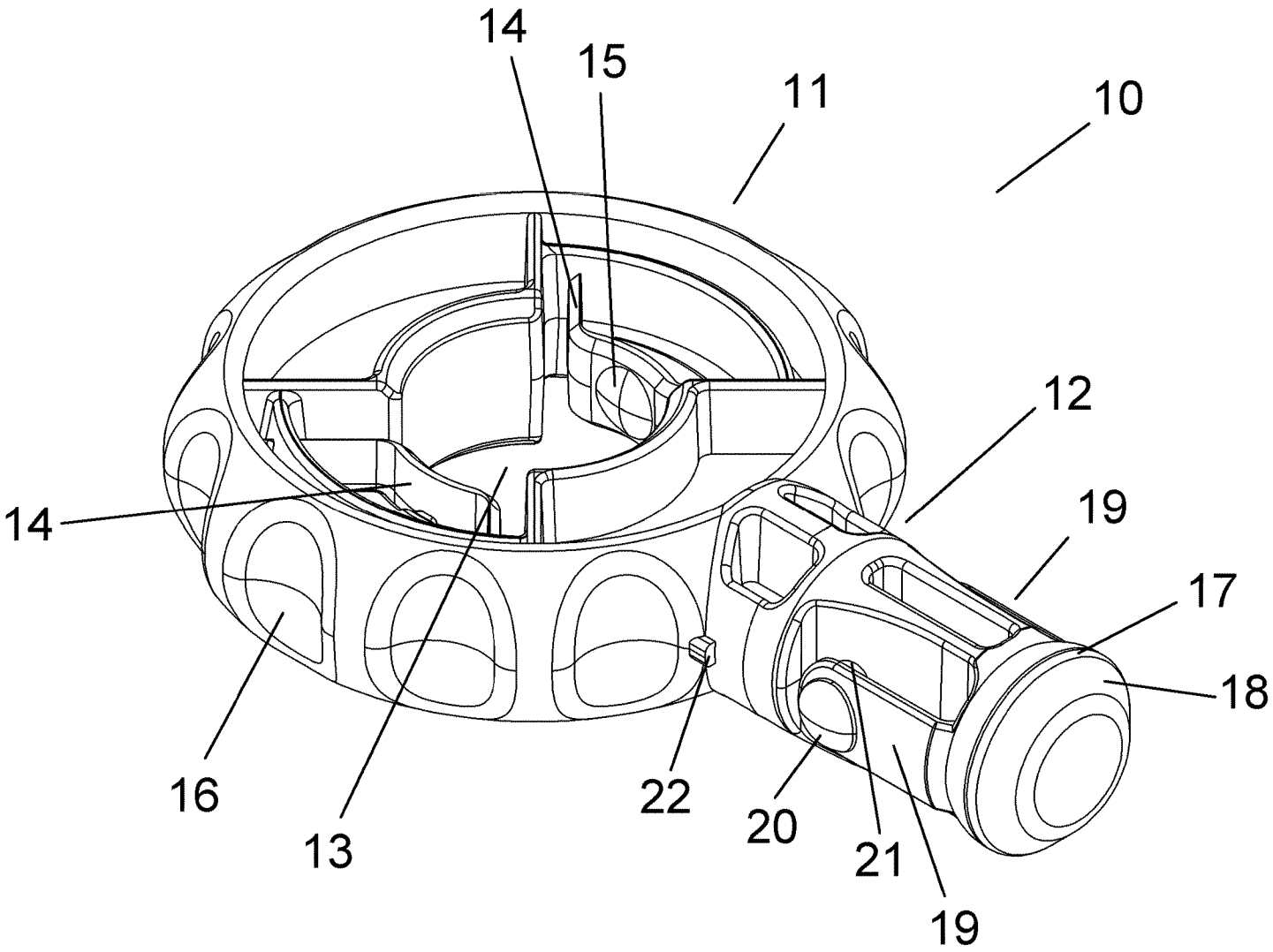
FIG. 1 is a perspective view of a tube connector of the invention.

The following provides a list of the reference characters used in the drawings:

10. Tube connector
11. Center portion
12. Projecting member
13. Center opening
14. Center flexing member
15. Center button
16. Knurl
17. Tip
18. Bevel
19. Flexing tab
20. Tab button
21. Tab stop
22. Abutment
23. Center tab
24. Open space
25. Tube
26. Tube opening
27. Second tube connector
28. Third tube connector
29. Fourth tube connector
30. Fifth tube connector
31. Sixth tube connector
32. Seventh tube connector
33. Eighth tube connector
34. Ninth tube connector
35. Tenth tube connector
36. Eleventh tube connector
37. Twelfth tube connector
38. Thirteenth tube connector
39. Fourteenth tube connector
40. Fifteenth tube connector
41. Straight center portion
42. Play structure
43. Center portion proximate end
44. Non-center portion proximate end
45. Flexing end As seen in FIG. 1, a particular tube connector 10 of the invention comprises a center portion 11 and one projecting member 12 which is attached to center portion 11. A center opening 13, suitably sized to admit a tube, extends through center portion 11. Said another way, the center opening and the outer part of the tube should be suitably sized such that the tube slides into the center opening in a free and easy manner, but the tube should also fit snugly in the center opening without excessive clearance.

Two center flexing members 14 are located opposite each other on the periphery of center opening 13. Center flexing members 14 serve to maintain tension on an inserted tube, and prevent inadvertent movement of the tube after it has been inserted into center opening 13. A center button 15, having a beveled circular shape, is located on each center flexing member 14 and extends inward into center opening 13. Center button 15 can engage with an opening on an inserted tube, to further secure the tube within center opening 13.

Center portion 11 has a knurled outer circumference—that is, knurls 16 or indentations are present at regularly-spaced intervals on the outer circumference. The knurls 16 or indentations, which are semi-circular or arcuatein nature, allow a user to more easily grip center portion 11 when adding tubes to tube connector 10, or when assembling tubes and tube connectors together into a play structure.

Projecting member 12 is attached to and projects outward from center portion 11. In this particular tube connector, projecting member 12 lies in the same plane as center portion 11, and is not angled up or down versus the center portion. Projecting member 12 has a circular tip 17 located at its non-center portion-proximate end 44. The circumference of tip 17 is substantially the same as the inner circumference of a tube which fits over projecting member 12, thus providing a snug fit for projecting member 12 inside the tube.

Said another way, the projecting member and the inner part of the tube should be suitably sized such that the tube slides over the projecting member in a free and easy manner, but the tube and projecting member should also fit together snugly without excessive clearance. Tip 17 also has a bevel 18 on its leading edge, in order to facilitate the placing of a tube over the end of projecting member 12. The end of projecting member 12 close to center portion 11 is generally cylindrical, apart from two cut-outs at the top and bottom, and has substantially the same circumference as the inner part of the tube.

Two flexing tabs 19 are also located on opposing sides of projecting member 12. Flexing tabs 19 are fixed at their non-center portion-proximate ends, and are free to flex inward and outward—i.e., toward and away from the main body of projecting member 12—at their center portion-proximate ends. In other words, the flexing tabs of the invention are fixed at their leading edge and flex in and out at their trailing edge, when a tube is placed over the projecting member. This configuration allows for the flexing tabs to flex outward against the tube at a location significantly back from the non-center portion-proximate end 44 of the projecting member, after the tube is placed over the projecting member. Said another way, this configuration provides more consistent support for the tube along the length of the projecting member and better holds the tube in place.

A tab button 20, having a beveled circular shape, is located on the flexing end 45 of flexing tab 19. As further discussed with regard to FIGS. 4-7, tab button 20 fits into a corresponding circular through-opening on a tube placed over projecting member 12. A tab stop 21 is located on the main body of projecting member 12, and serves to limit the inward movement of flexing tab 19 toward the main body of projecting member 12. Abutments 22 are located on opposite sides of the center portion-proximate end 43 of projecting member 12, and these abutments provide stable resting surfaces for the tube end when the tube is fully in position over projecting member 12.

In sum, and as further shown in FIGS. 4-7, a tube fully in position over projecting member 12 is well supported at the non-center portion-proximate end 44 of the projecting member by tip 17 pressing against the inner part of the tube; is also well supported between the center portion-proximate end 43 and non-center portion-proximate end 44 of projecting member 12 by the flexing tabs 19 pressing against the inner part of the tube; and is also well supported by the cylindrical nature of the projecting member at its center portion-proximate end 43.

Figure 2:
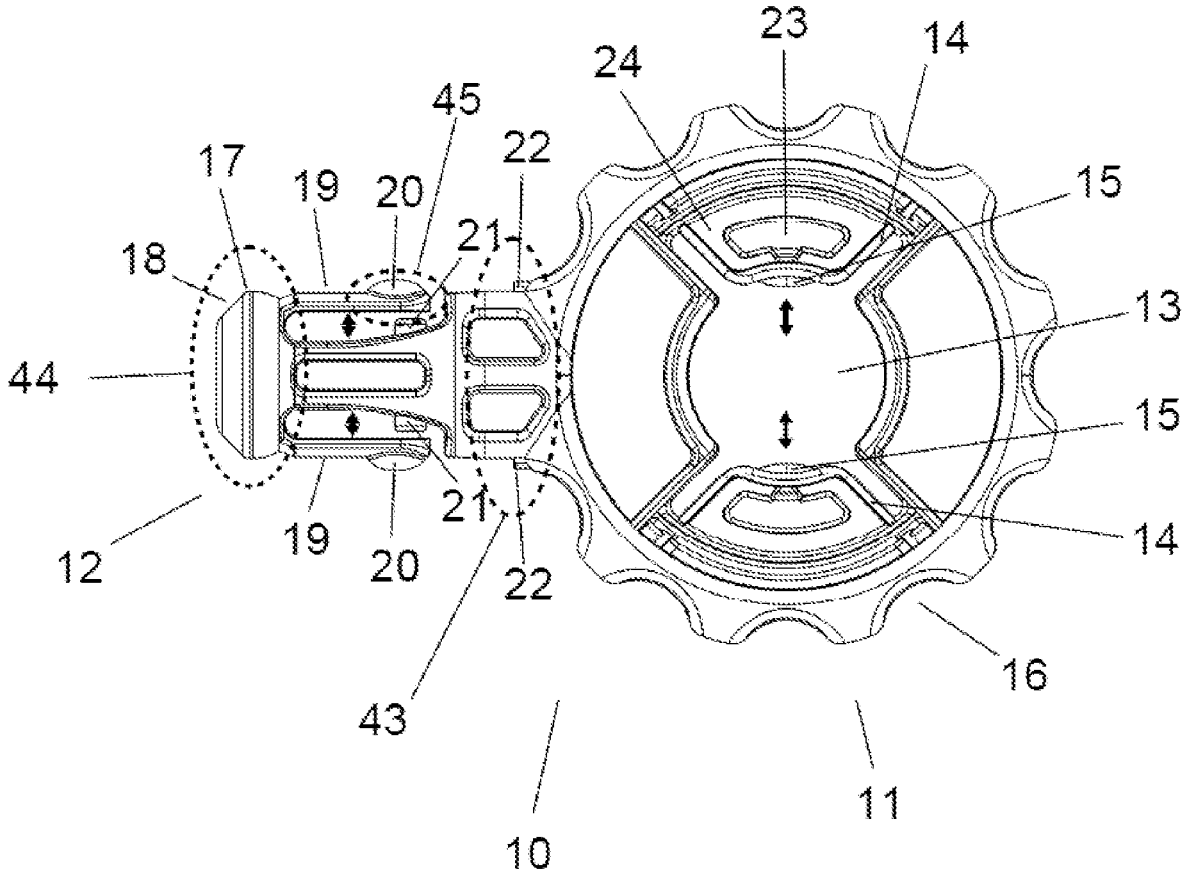
FIG. 2 is a top view of the tube connector shown in FIG. 1.

Tube connector 10 is further shown in FIG. 2, in a top view. The ability of flexing tabs 19 to move toward and away from the main body of projecting member 12 is indicated by the arrows shown between the flexing tabs and the main body of the projecting member. The ability of center flexing members 14 to move toward and away from center opening 13 is indicated by the arrows shown in that area. A center tab 23 is attached to center flexing member 14 on the side that is opposite center button 15. A void or open space 24 surrounds center tab 23, and this open space between the back wall of center flexing member 14 and the main body of center portion 11 allows center flexing member 14 to move toward and away from center opening 13 when a tube is inserted or removed from the center opening. Put another way, center flexing member 14 is attached only at its ends to the main body of center portion 11, and this allows center flexing member 14 to flex back and forth.

Figure 3:
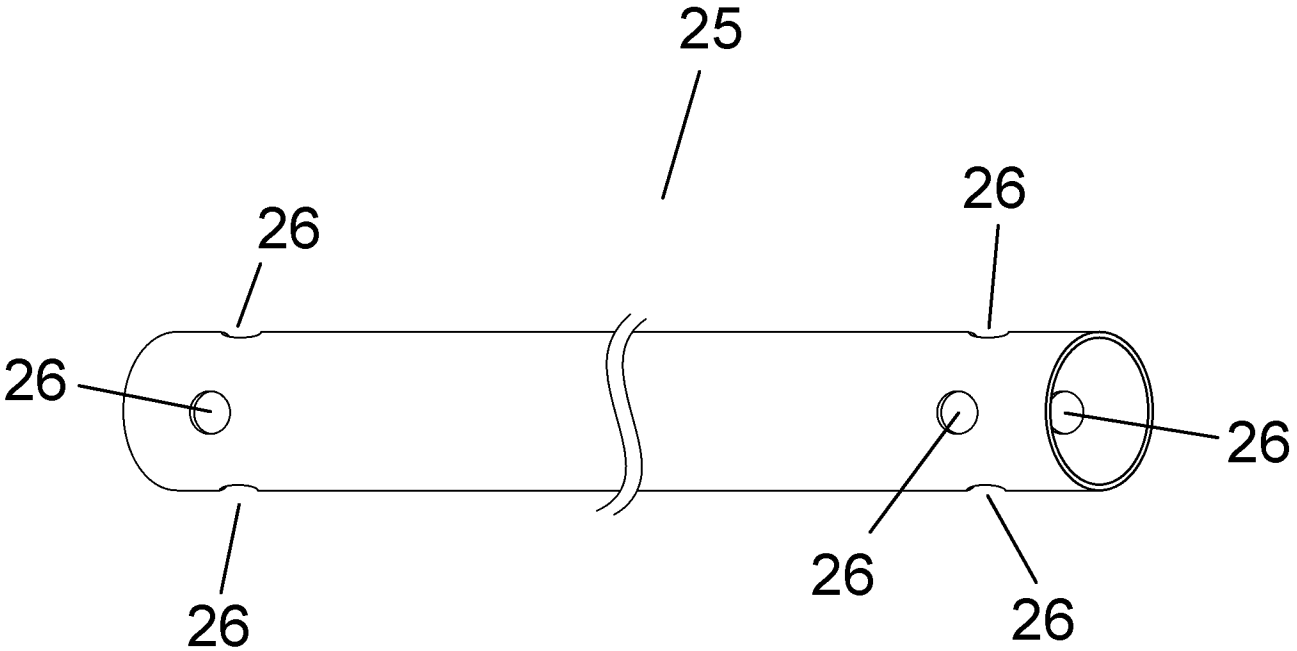
FIG. 3 is a perspective view of a tube of the invention.

FIG. 3 illustrates the tube 25 of the invention, which connects in various ways to the various tube connectors described herein in order to form play structures. Tube 25 is substantially round and hollow, and as indicated in FIG. 3, comes in any suitable length from short to long. Four substantially circular tube openings 26 are located around the circumference of each end of tube 25. Tube openings 26 are spaced 90 degrees from each other around the circumference of tube 25, such that there are openings through the wall of tube 25 at the top, bottom, and sides thereof. Tube openings 26 correspond with center buttons 15 or tab buttons 20, depending on whether tube 25 is inserted into center opening 13 or placed over projecting member 12, as further discussed below with regard to FIGS. 4-9.

Figure 4:
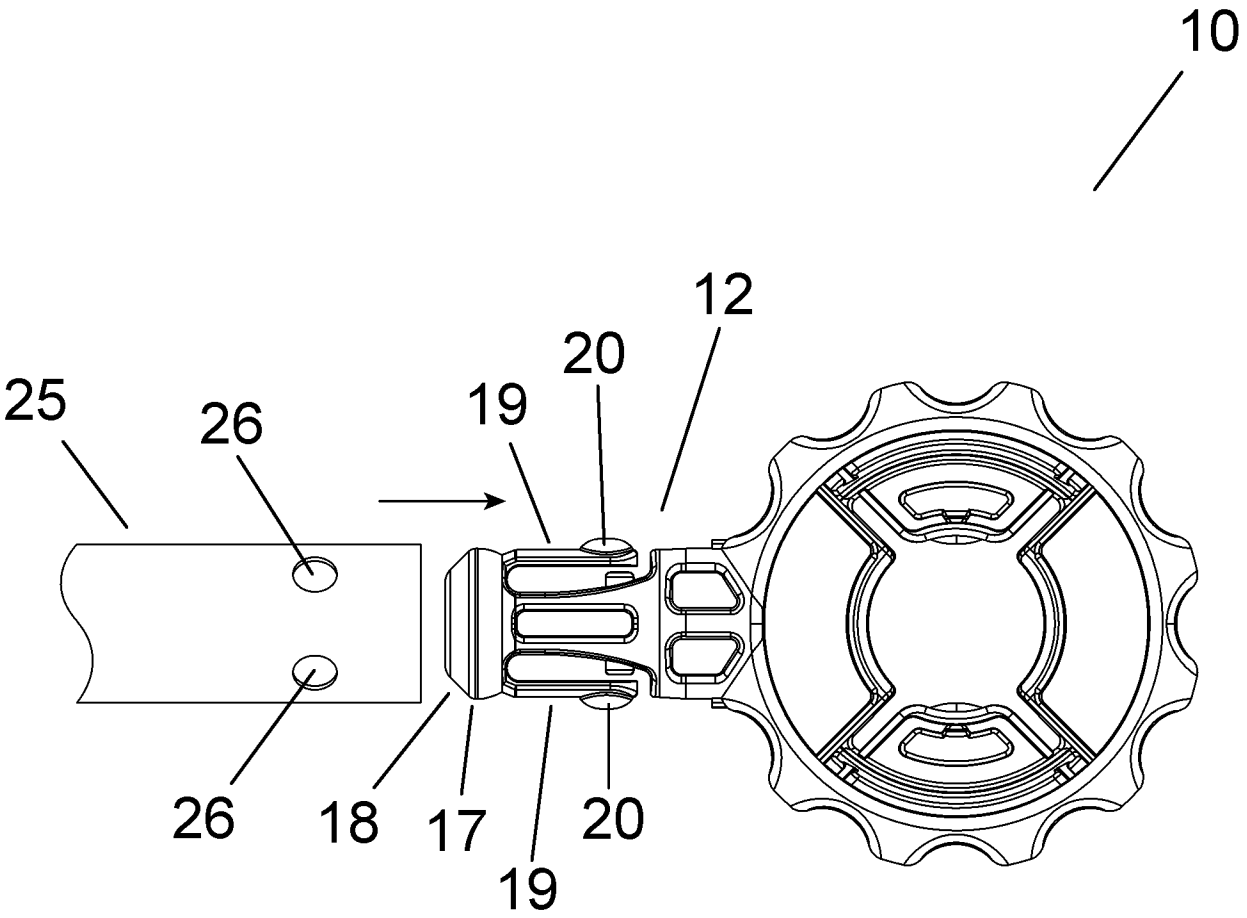
FIG. 4 is a top view of the tube in position for placement over the projecting member.

FIG. 4 shows tube 25 in position for placement over projecting member 12. Tube 25 is first positioned lengthwise with its hollow end next to tip 17 of projecting member 12, and then tube 25 is pushed inward over projecting member 12 towards center portion 11, as indicated by the directional arrow. It should be noted that in this figure, tube openings 26 in tube 25 are not yet aligned with tab buttons 20 of projecting member 12. Thus, when tube 25 is pushed over projecting member 12, flexing tabs 19 are pushed inward toward tab stops 21 and are held there by the inner wall of tube 25.

Figure 5:
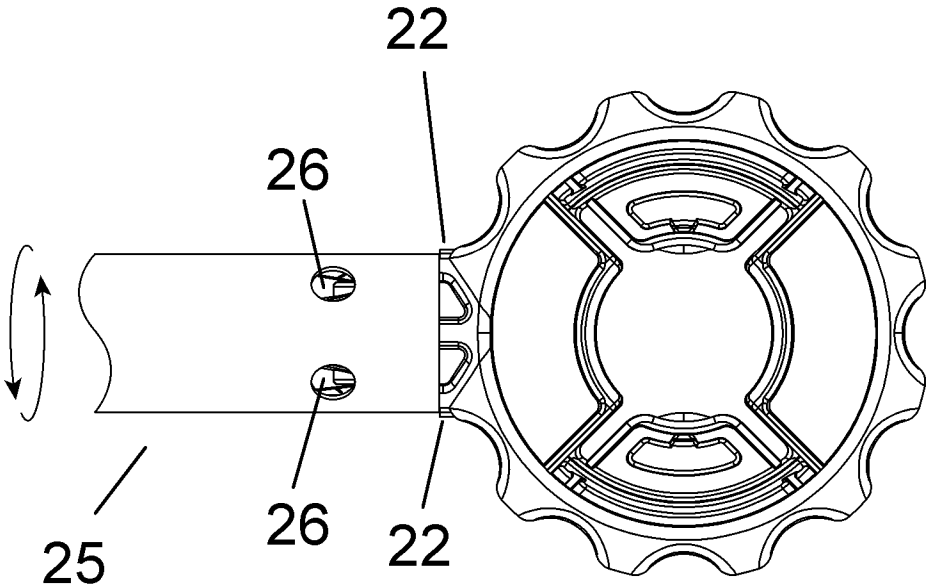
FIG. 5 is a top view of the tube fully pushed over the projecting member, before the tube openings are engaged with the flexing tab buttons.
Figure 6:
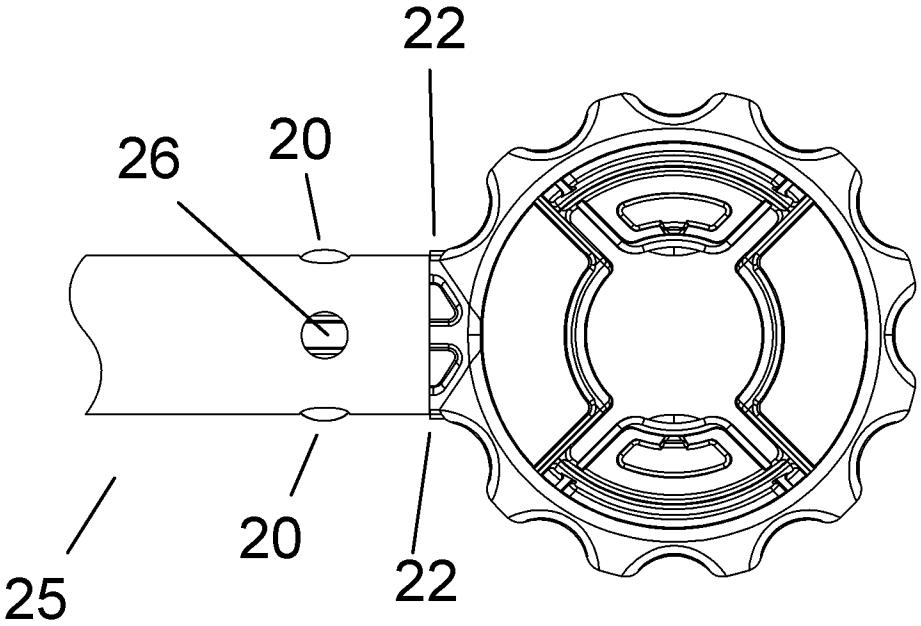
FIG. 6 is a top view of the tube fully locked in place on the projecting member, wherein the tube openings are engaged with the flexing tab buttons.

FIG. 5 shows tube 25 fully pushed over projecting member 12, with the end of tube 25 butting up against abutments 22. Tab buttons 20 on flexing tabs 19 do not yet extend through tube openings 26, because tube openings 26 and tab buttons 20 are not yet aligned with each other. To align tube openings with tab buttons 20, tube 25 is twisted or rotated about projecting member 12 as indicated by the directional arrow, until tube openings 26 are brought in line with tab buttons 20. When the tube openings are aligned over the tab buttons, flexing tabs 19 move outward from the main body of projecting member 12, and tab buttons 20 extend through tube openings 26 and thereby lock tube 25 in place on projecting member 12. The fully locked-in position of tube 25 on projecting member 12 is shown in FIG. 6.

Figure 7:
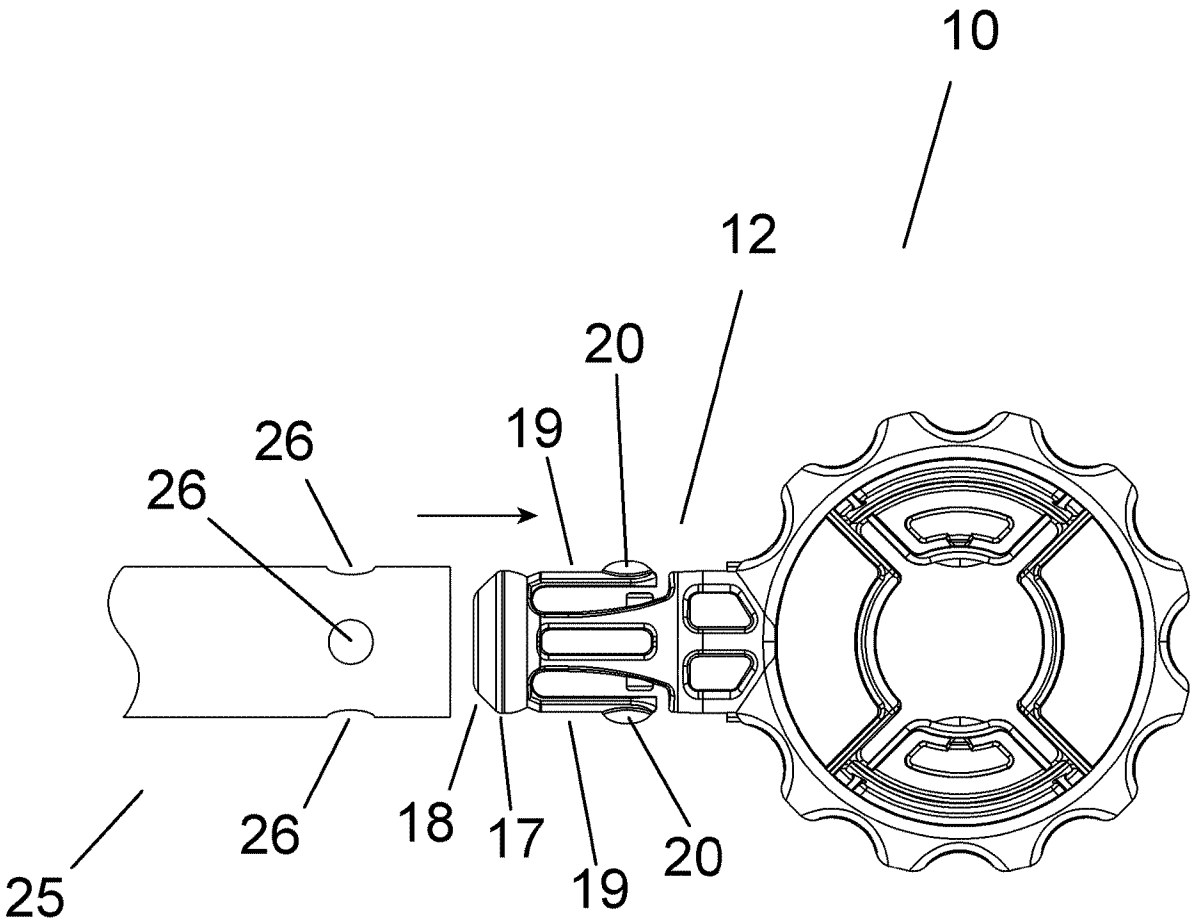
FIG. 7 is a top view of the tube in position for "straight-on" placement over the projecting member, wherein the tube openings are pre-aligned with the flexing tab buttons.

FIG. 7 shows tube 25 in position for "straight-on" placement over projecting member 12. In this figure, tube openings 26 at the sides of tube 25 are pre-aligned with tab buttons 20 which are also at the sides of projecting member 12. Thus, when tube 25 is pushed straight onto projecting member 12 as indicated by the directional arrow, tab buttons 20 will extend into tube openings 26 and lock the tube onto the projecting member without any twisting required. When the tube is fully seated on the projecting member in this situation, the tube and tube connector are as shown in FIG. 6.

Removal of tube 25 from projection member 12 is basically the opposite of installation. With sufficient force, tube 25 can be pulled straight off projecting member 12, as the beveled nature of tab buttons 20 allow tube openings 26 to ride back over them. During the removal process, each flexing tab 19 will be forced inward towards tab stop 21, and tube 25 can then be easily pulled off projecting member 12.

Alternatively, tube 25 can first be twisted or rotated about projecting member 12 until tube openings 26 are no longer aligned with tab buttons 20. Flexing tabs 19 will be forced inward towards tab stops 21, thus allowing tube 25 to be easily pulled off projecting member 12.

Figure 8:
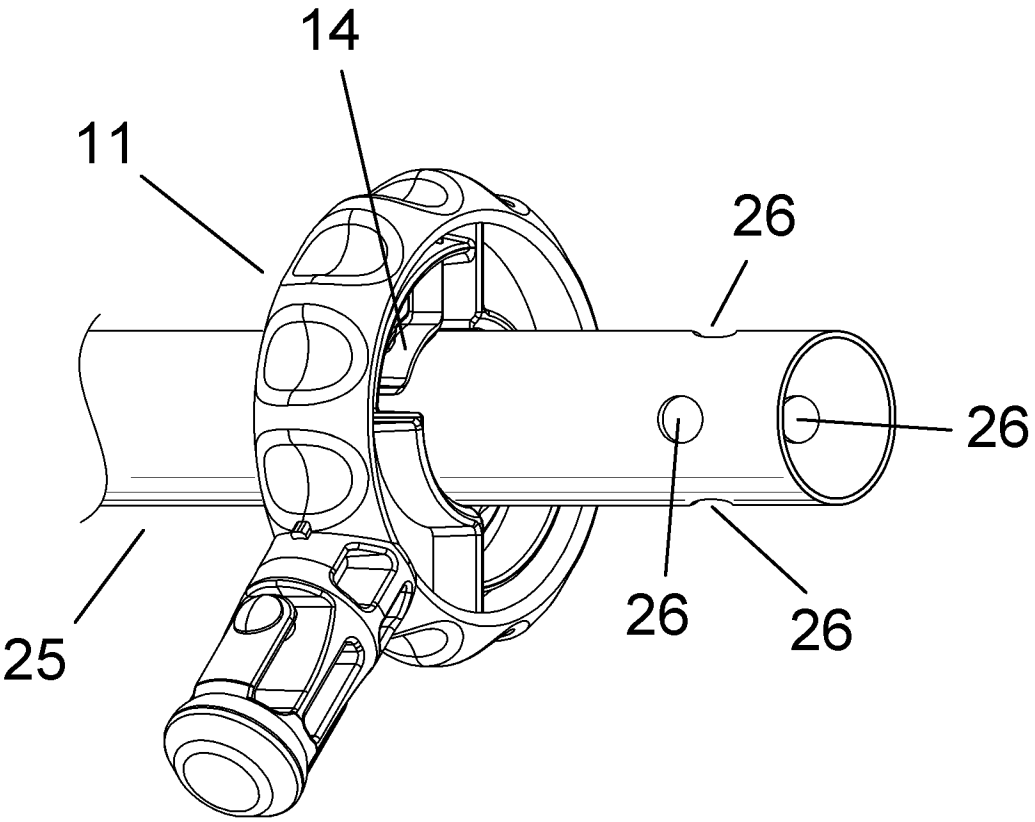
FIG. 8 is a perspective view of the tube connector shown in FIG. 1, with a tube inserted through the center opening in the tube connector.

FIG. 8 illustrates a tube 25 inserted into center opening 13. In this figure, tube openings 26 are not engaged with center buttons 15. Instead, center flexing members 14 located on opposite sides of center opening 13, and center buttons 15 on the center flexing members, move back as tube 25 is inserted and then press against the outer wall of tube 25 to hold the tube in place in the center opening. Thereafter, a reasonable amount of force can move tube connector 10 along the length of tube 25, but the tube connector will not move inadvertently in relation to the tube.

Figure 9:
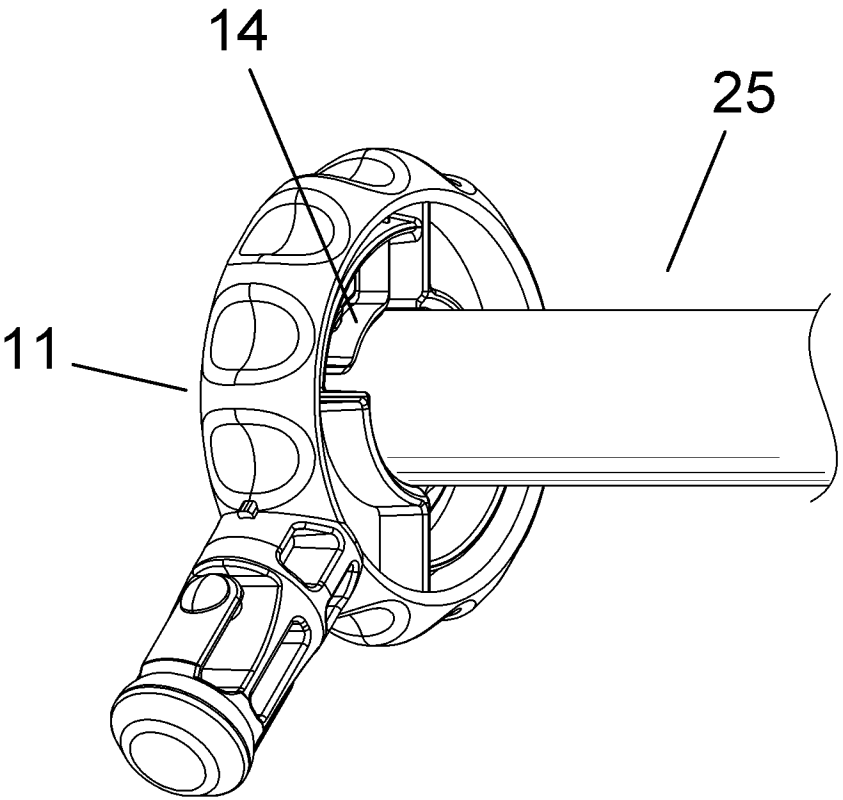
FIG. 9 is a perspective view of the tube connector shown in FIG. 1, with a tube inserted into the center opening of the tube connector and the tube openings engaged with the tube connector center buttons.

FIG. 9 also depicts a tube 25 inserted into center opening 13. In this figure, tube openings 26 on opposite sides of tube 25 are engaged with center buttons 15 on opposite sides of center opening 13. Similar to when tube 25 is pushed onto a projecting member, in order to engage the tube openings with the center buttons, tube 25 can be pushed into center opening 13 with the tube openings and center buttons not pre-aligned. In this case, a simple twist or rotation of tube 25 in center opening 13 (or, said another way, a twist or rotation of tube connector 10 about tube 25) is used to align the tube openings with the center buttons. Once center buttons 15 are aligned over tube openings 26, center flexing members 14 flex back toward the tube and the center buttons extend into the tube openings, thus locking the tube in place in the tube connector.

Removal of tube 25 from center opening 13 is basically the opposite of installation. With sufficient force, tube 25 can be pulled straight out of center opening 13, as the beveled nature of center buttons 15 allow tube openings 26 to ride back over them. During the removal process, center flexing members 14 will be forced slightly outward, and tube 25 can then be easily pulled out of center opening 13.

Alternatively, tube 25 can first be twisted or rotated inside center opening 13 until tube openings 26 are no longer aligned with center buttons 15. Center flexing members 14 will be forced outward, thus allowing tube 25 to be easily pulled out of center opening 13.

FIGS. 10 to 35 illustrate other tube connectors of the invention. These other tube connectors have multiple projecting members attached to a center portion at various angles to each other. In some of these tube connectors, the projecting members lie in the same plane as each other and in the same plane as the center portion. In other tube connectors, the projecting members lie in different planes from each other (i.e., a projecting member may be tilted up from the plane of another connector); and/or the projecting members lie in a different plane from the center portion (i.e., a projecting member may be tilted up from the plane of the center portion).

These other tube connectors allow tubes to be connected together at various angles and in many different configurations to form a play structure. Other than having multiple projecting members at various angles and in various planes, the structures of these other tube connectors (i.e., the components of the projecting members and the components of the center portion) are the same as the structure of tube connector 10. Operationally, the manner in which a tube is connected to and disconnected from the projecting members, and the manner in which a tube is connected to and disconnected from the center portion, is the same as with tube connector 10.

Figure 10:
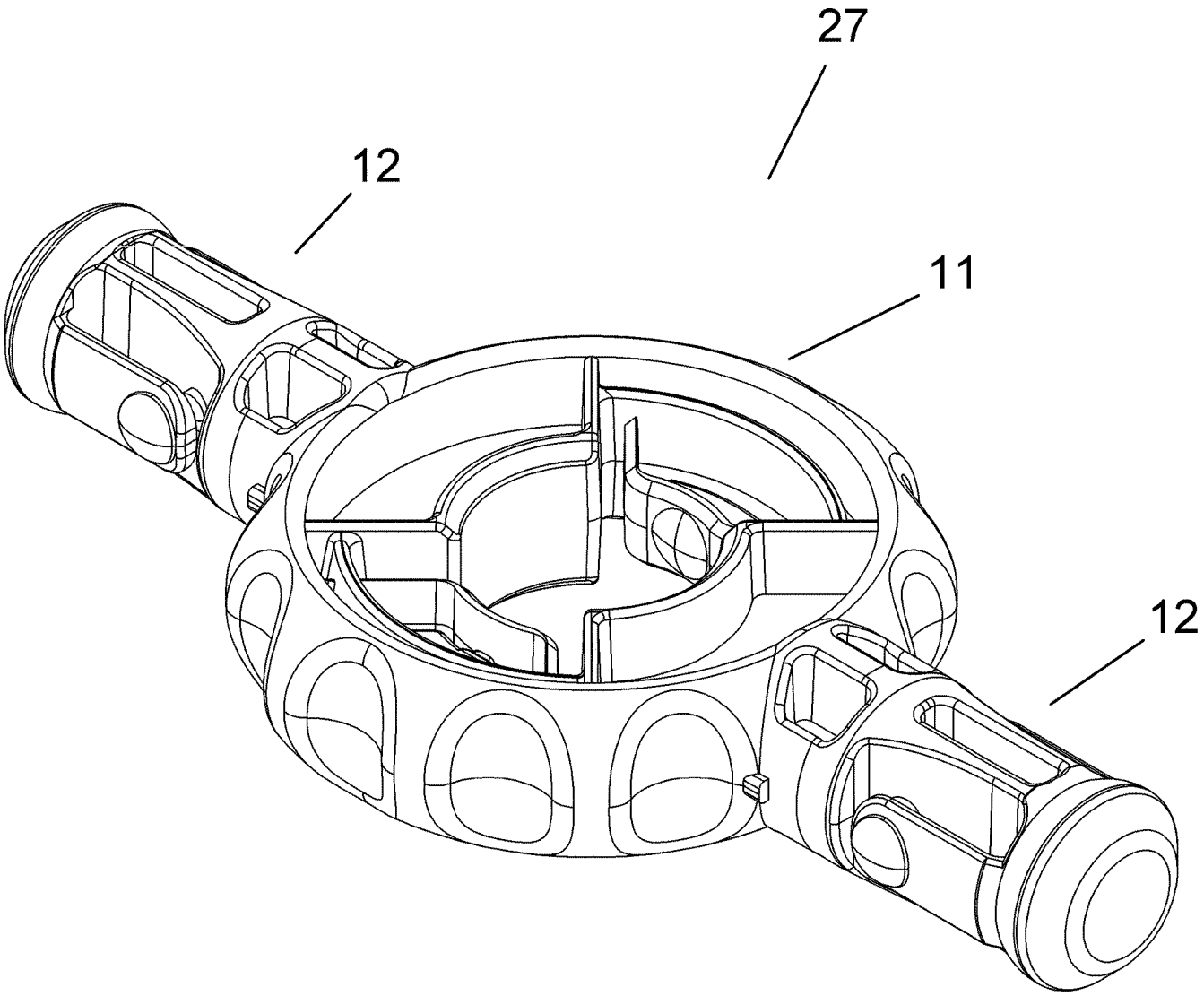
FIG. 10 is a perspective view of a second tube connector embodiment of the invention.
Figure 11:
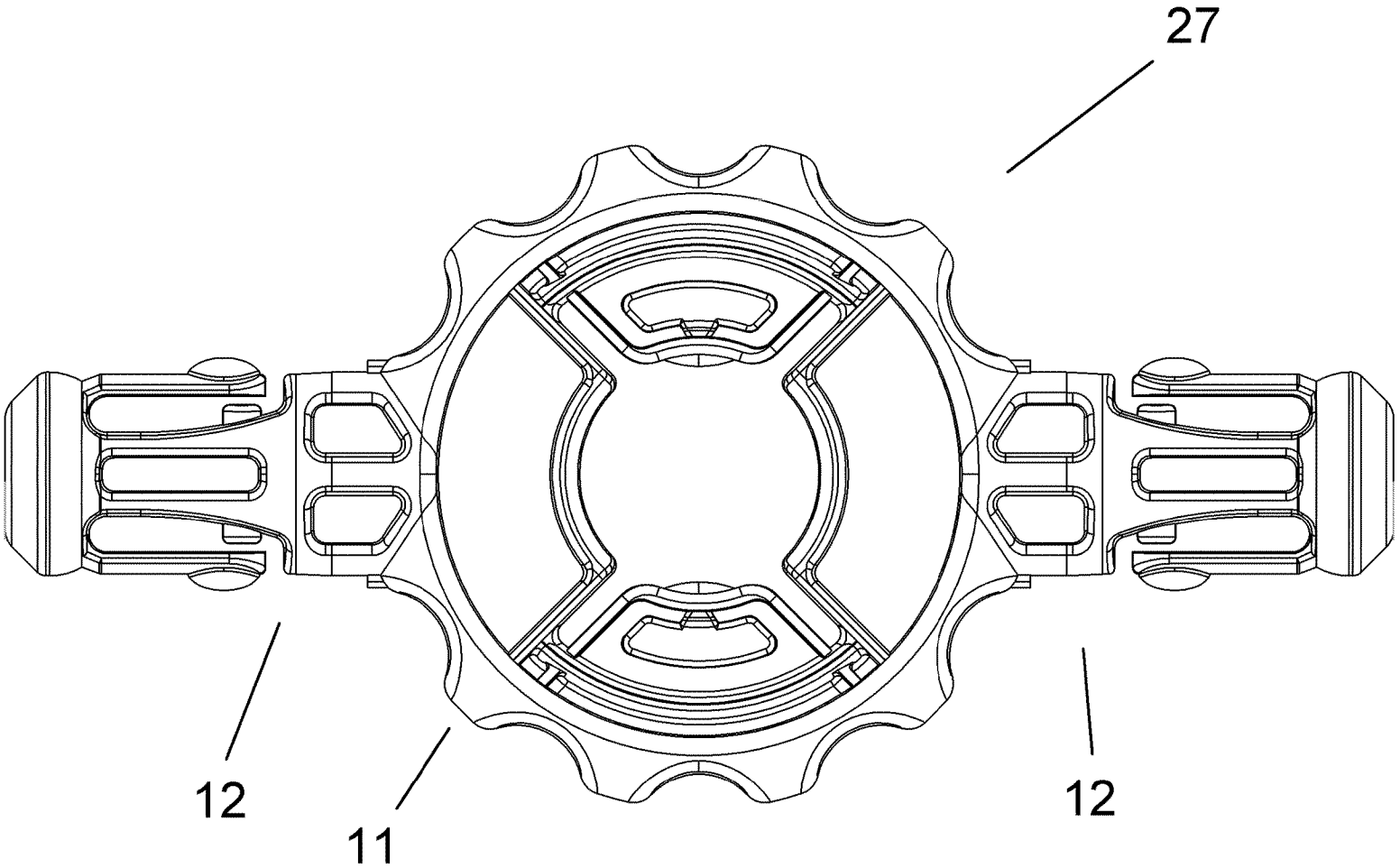
FIG. 11 is a top view of a second tube connector embodiment of the invention.

FIGS. 10 and 11 show a second tube connector 27, wherein two projecting members 12 are attached to a center portion 11 at substantially 180 degrees to each other. In this particular tube connector, projecting members 12 lie in the same plane as center portion 11, and are not angled up or down versus the center portion.

Figure 12:
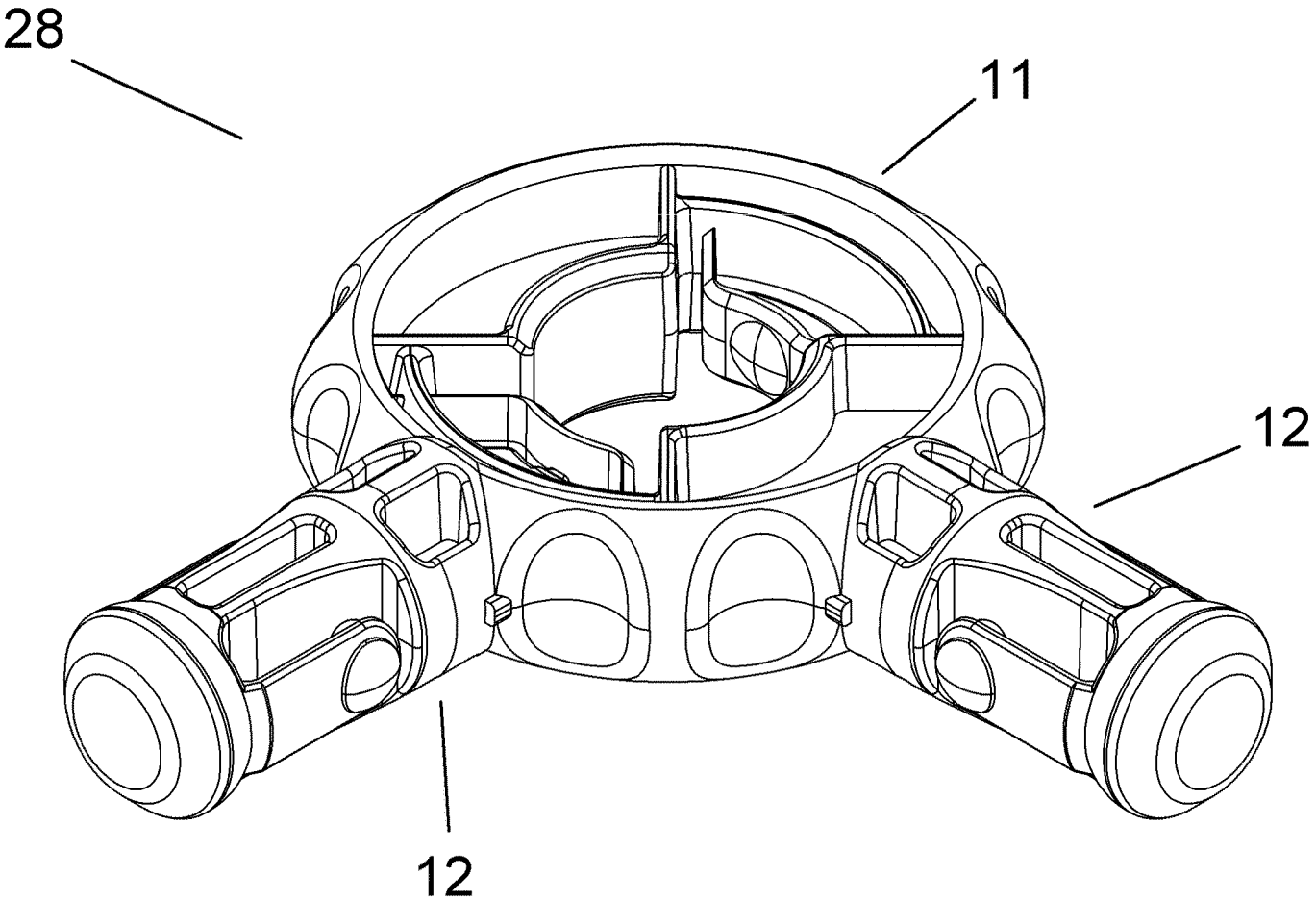
FIG. 12 is a perspective view of a third tube connector embodiment of the invention.
Figure 13:
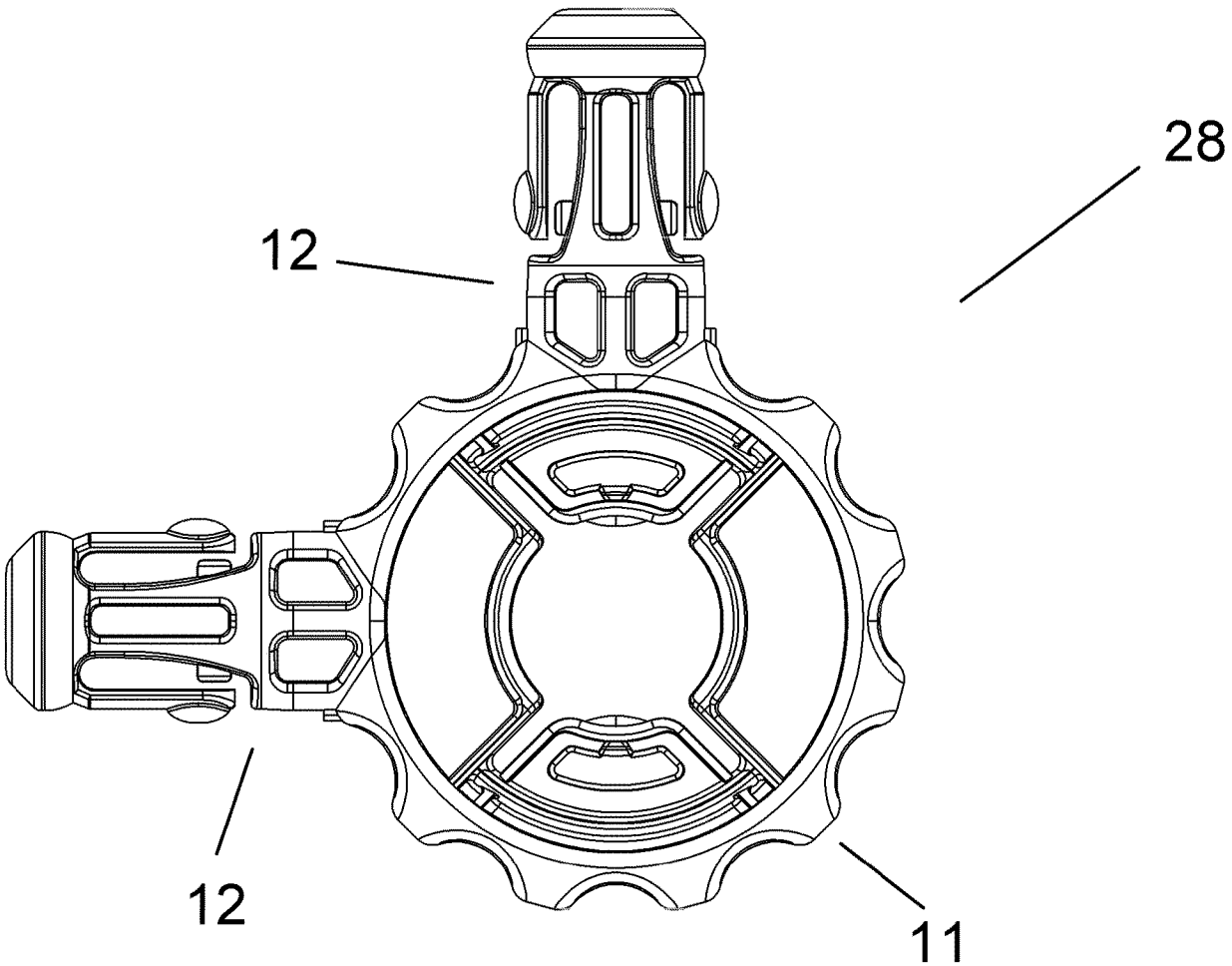
FIG. 13 is a top view of a third tube connector embodiment of the invention.

FIGS. 12 and 13 show a third tube connector 28, wherein two projecting members 12 are attached to a center portion 11 at substantially 90 degrees to each other. In this particular tube connector, projecting members 12 lie in the same plane as center portion 11, and are not angled up or down versus the center portion.

Figure 14:
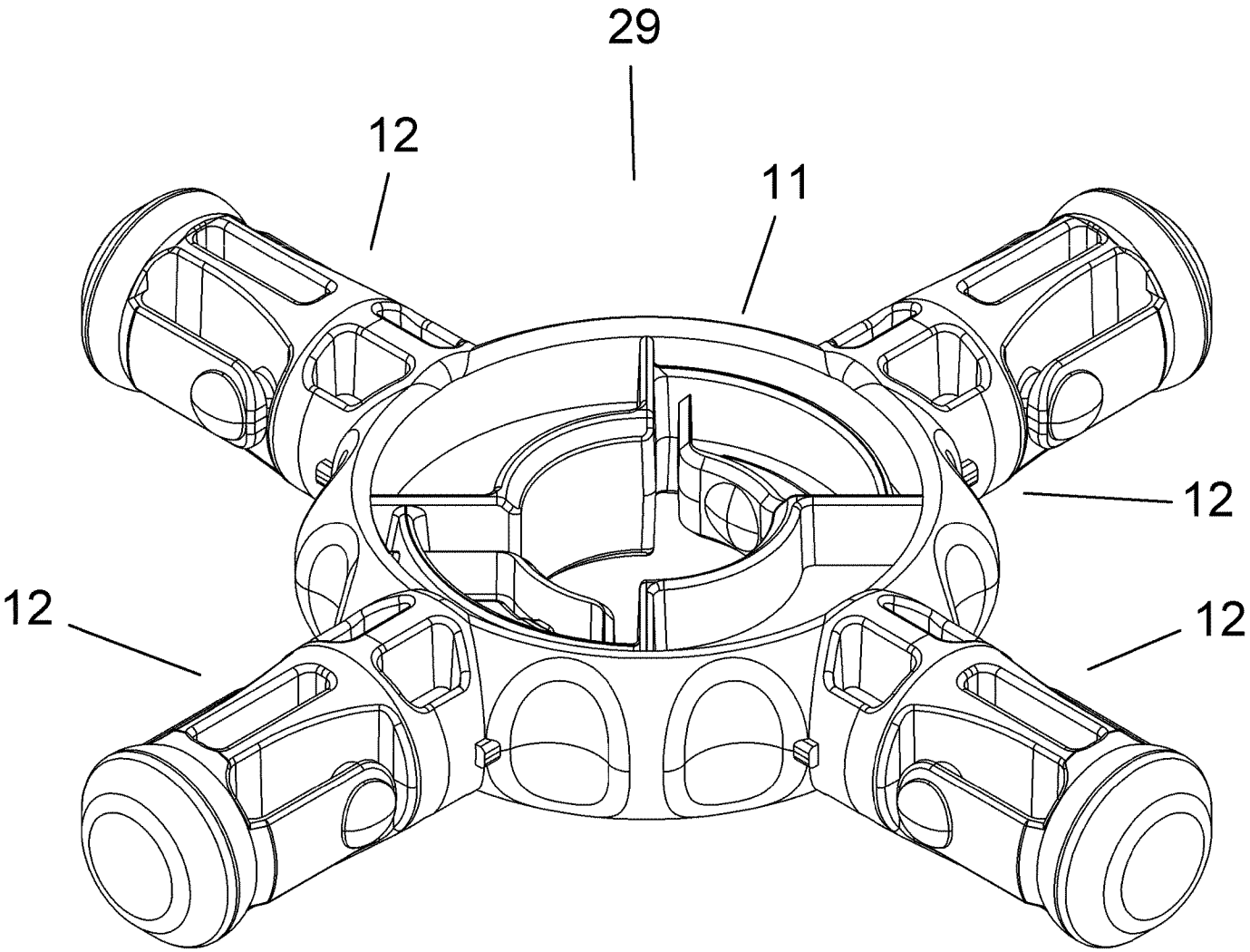
FIG. 14 is a perspective view of a fourth tube connector embodiment of the invention.
Figure 15:
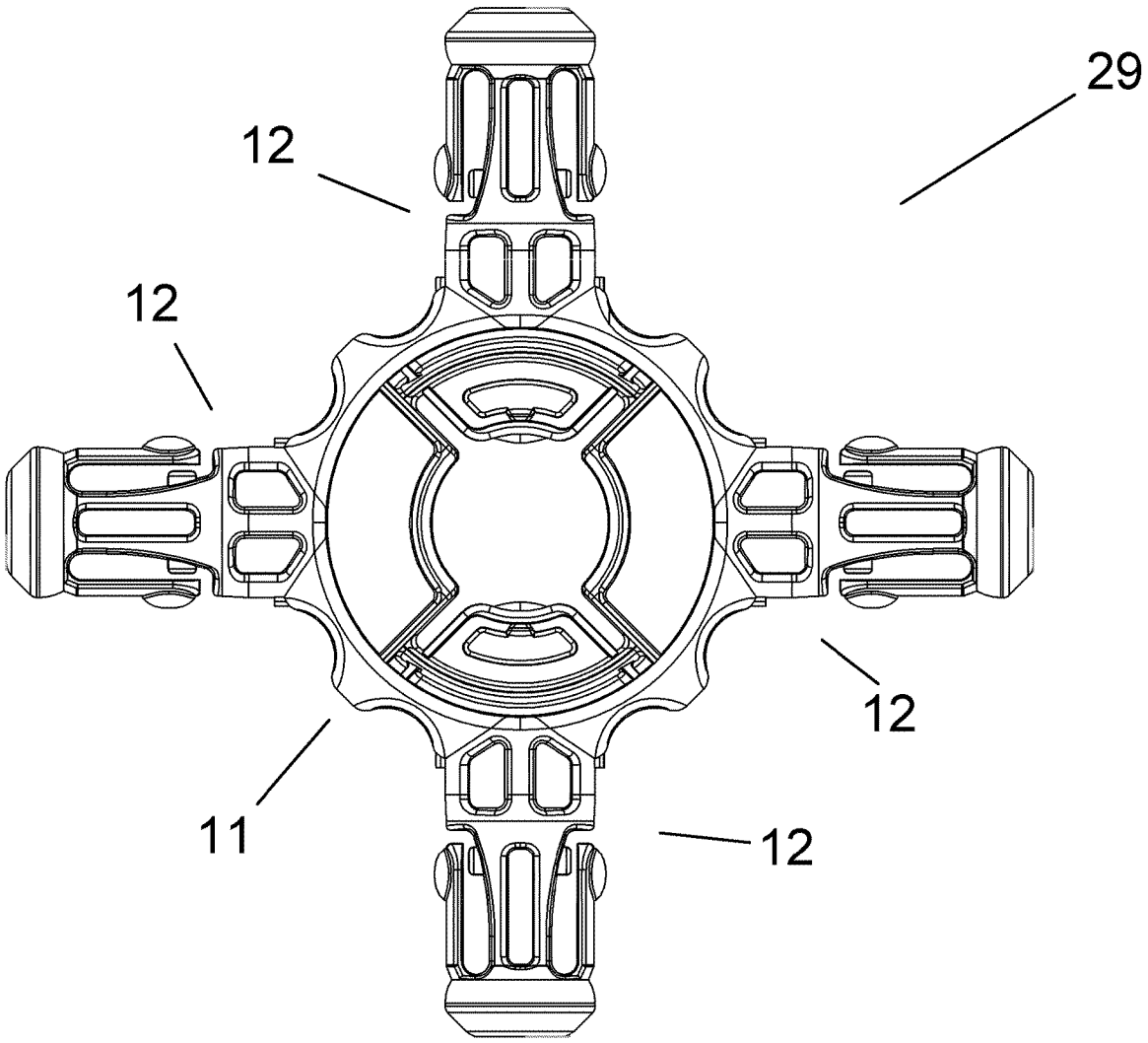
FIG. 15 is a top view of a fourth tube connector embodiment of the invention.

FIGS. 14 and 15 show a fourth tube connector 29, wherein four projecting members 12 are attached to a center portion 11 at substantially 90 degrees to each other. In this particular tube connector, projecting members 12 lie in the same plane as center portion 11, and are not angled up or down versus the center portion.

Figure 16:
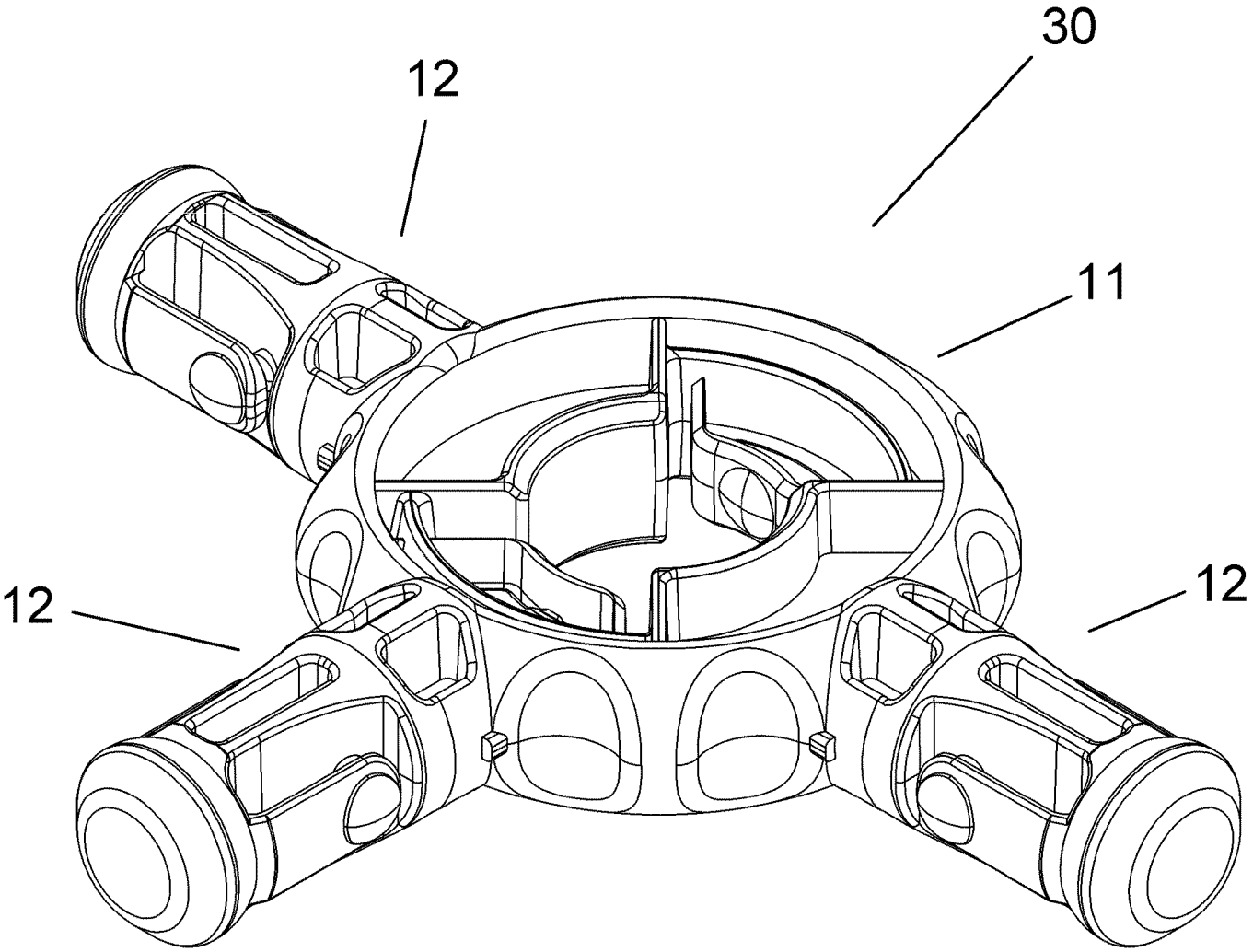
FIG. 16 is a perspective view of a fifth tube connector embodiment of the invention.
Figure 17:
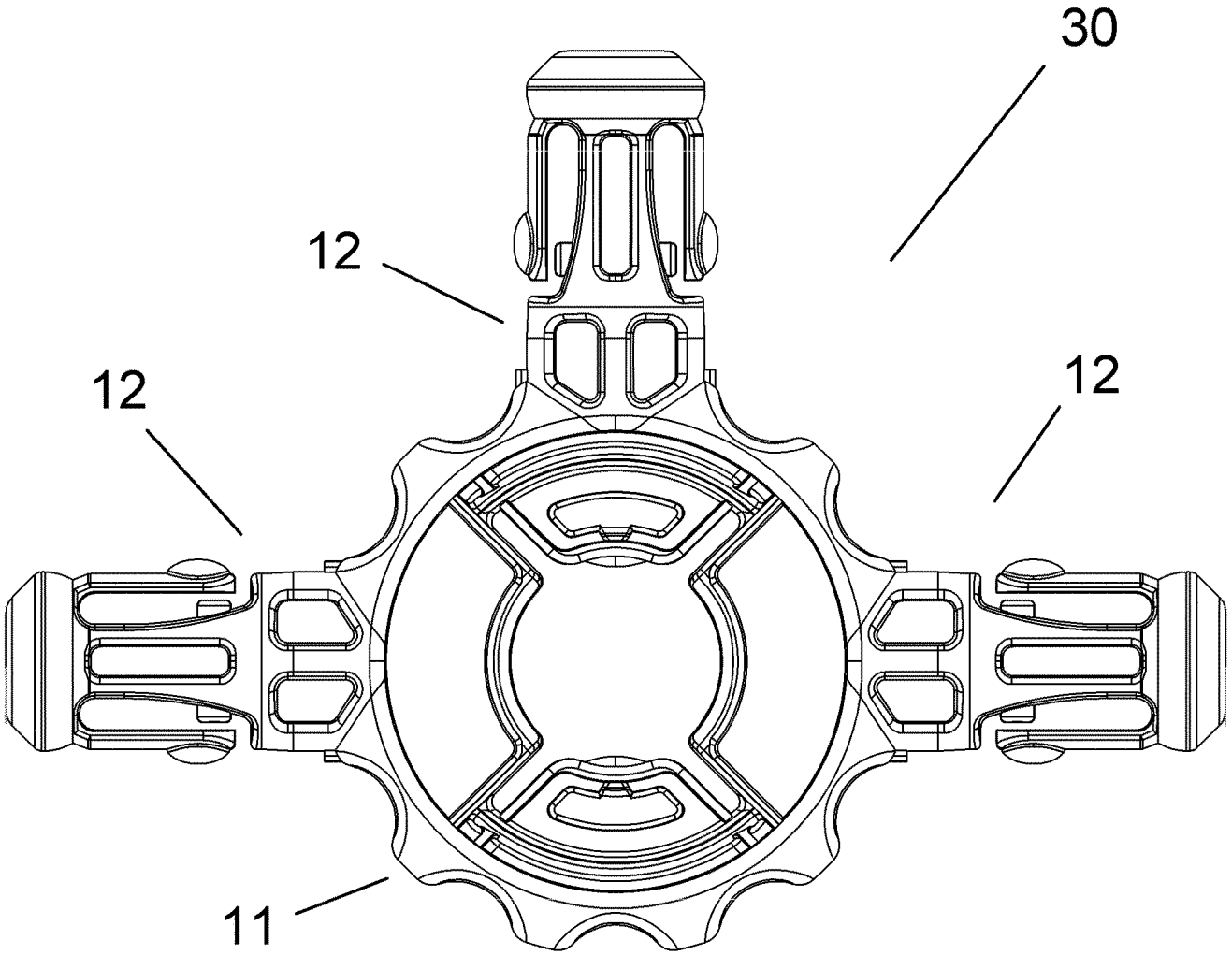
FIG. 17 is a top view of a fifth tube connector embodiment of the invention.

FIGS. 16 and 17 show a fifth tube connector 30, wherein three projecting members 12 are attached to a center portion 11 at substantially 90 degrees to each other. In other word, three "sides" of the center portion have projecting members attached, and one "side" has no projecting member. In this particular tube connector, projecting members 12 lie in the same plane as center portion 11, and are not angled up or down versus the center portion.

Figure 18:
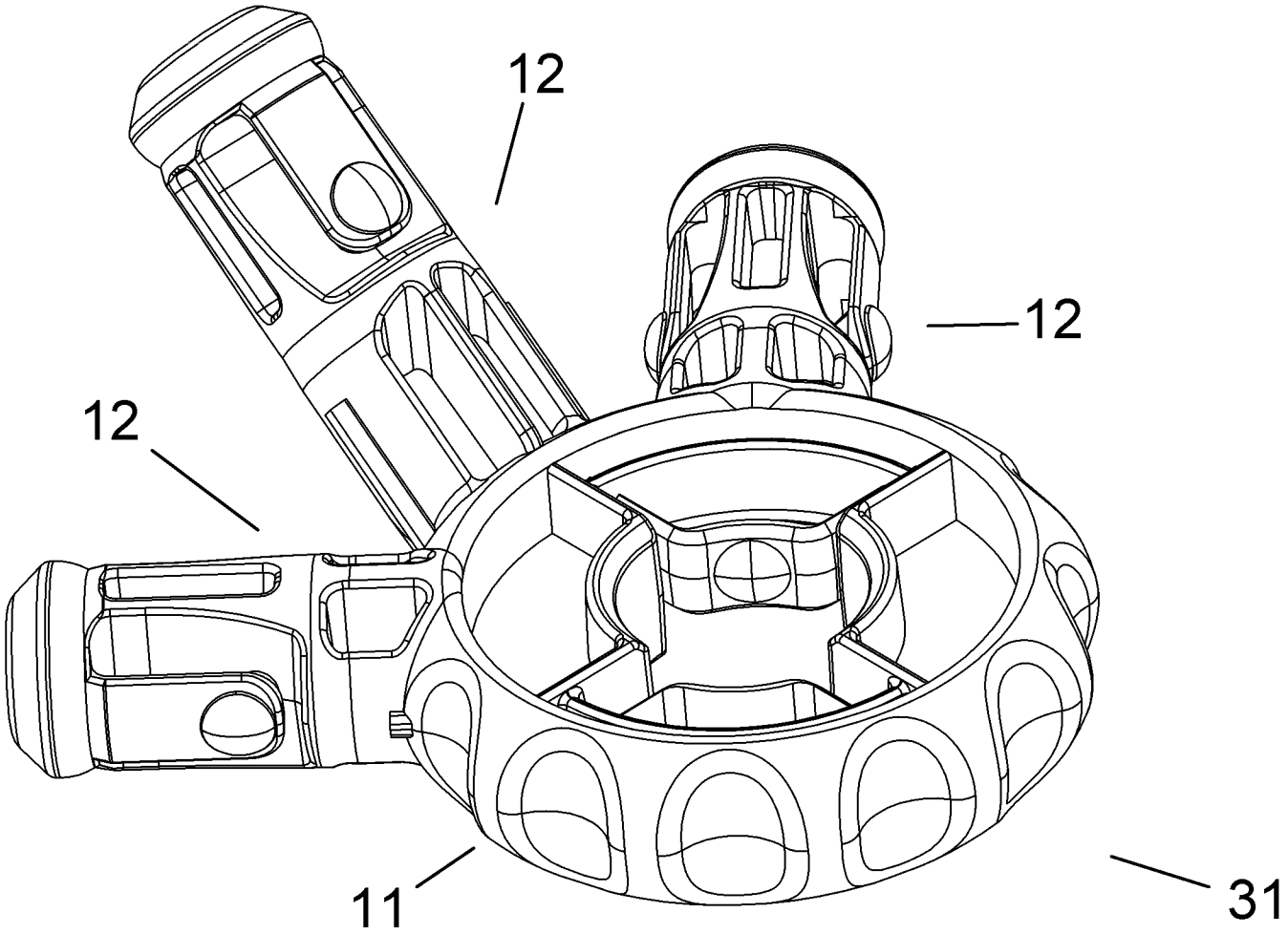
FIG. 18 is a perspective view of a sixth tube connector embodiment of the invention.
Figure 19:
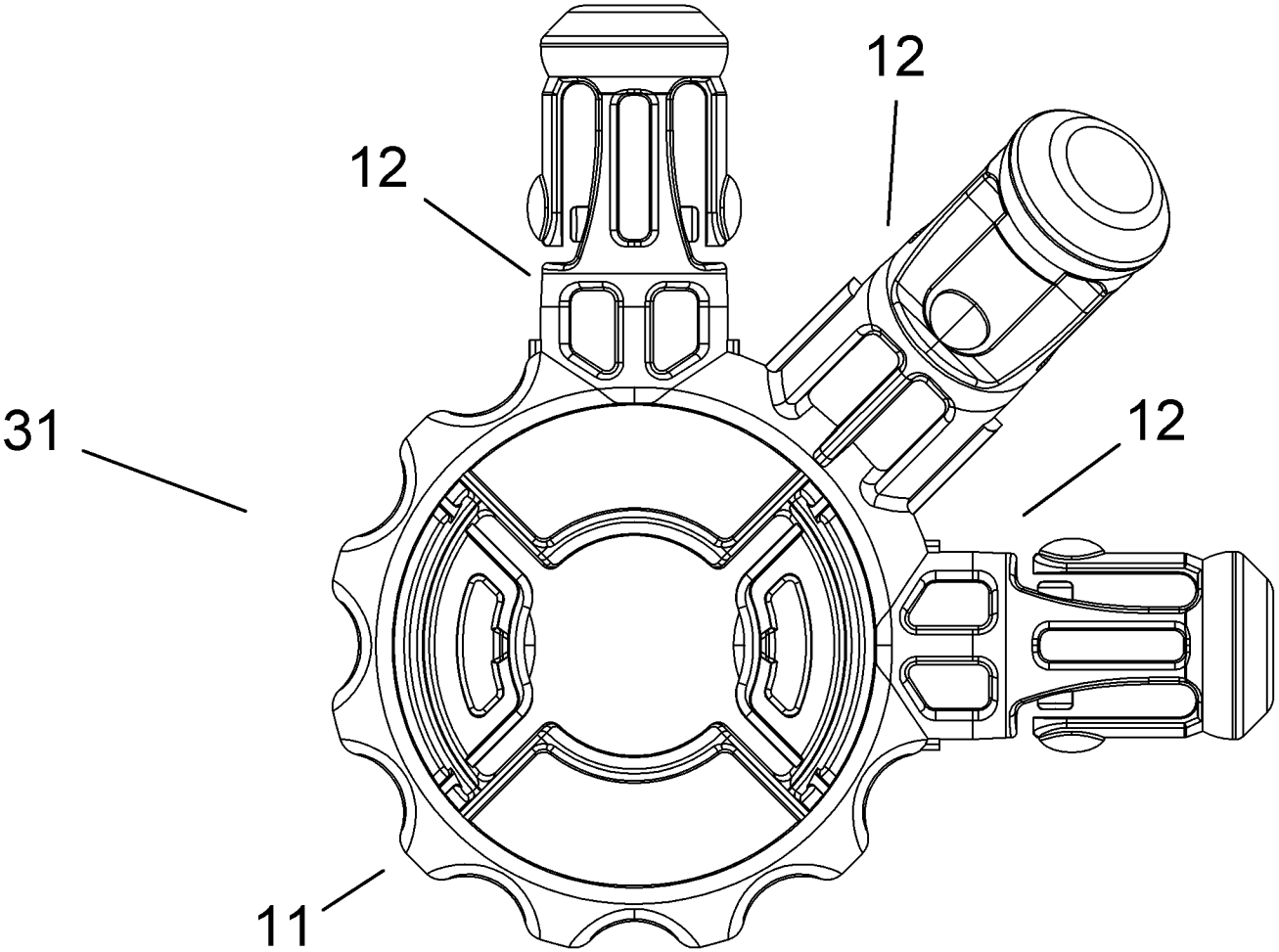
FIG. 19 is a top view of a sixth tube connector embodiment of the invention.

FIGS. 18 and 19 show a sixth tube connector 31, wherein two projecting members 12 are attached to a center portion 11 at substantially 90 degrees to each other. Another projecting member 12 is located between the two projecting members, substantially 45 degrees from each of them. The two projecting members 12 lie in the same plane as center portion 11, and the other projecting member 12 is tilted up from the plane of center portion 11 at substantially a 45 degree angle.

Figure 20:
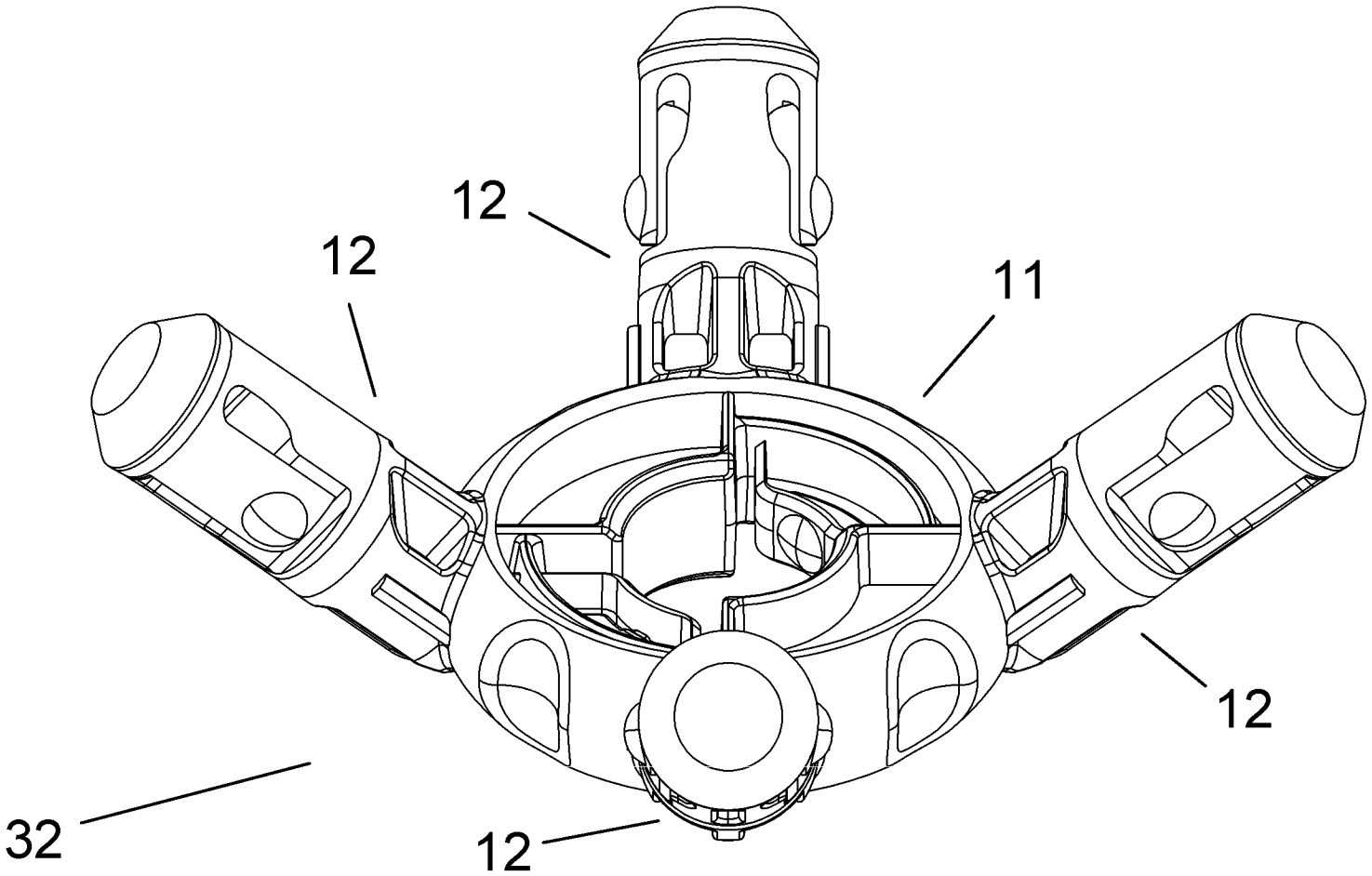
FIG. 20 is a perspective view of a seventh tube connector embodiment of the invention.
Figure 21:
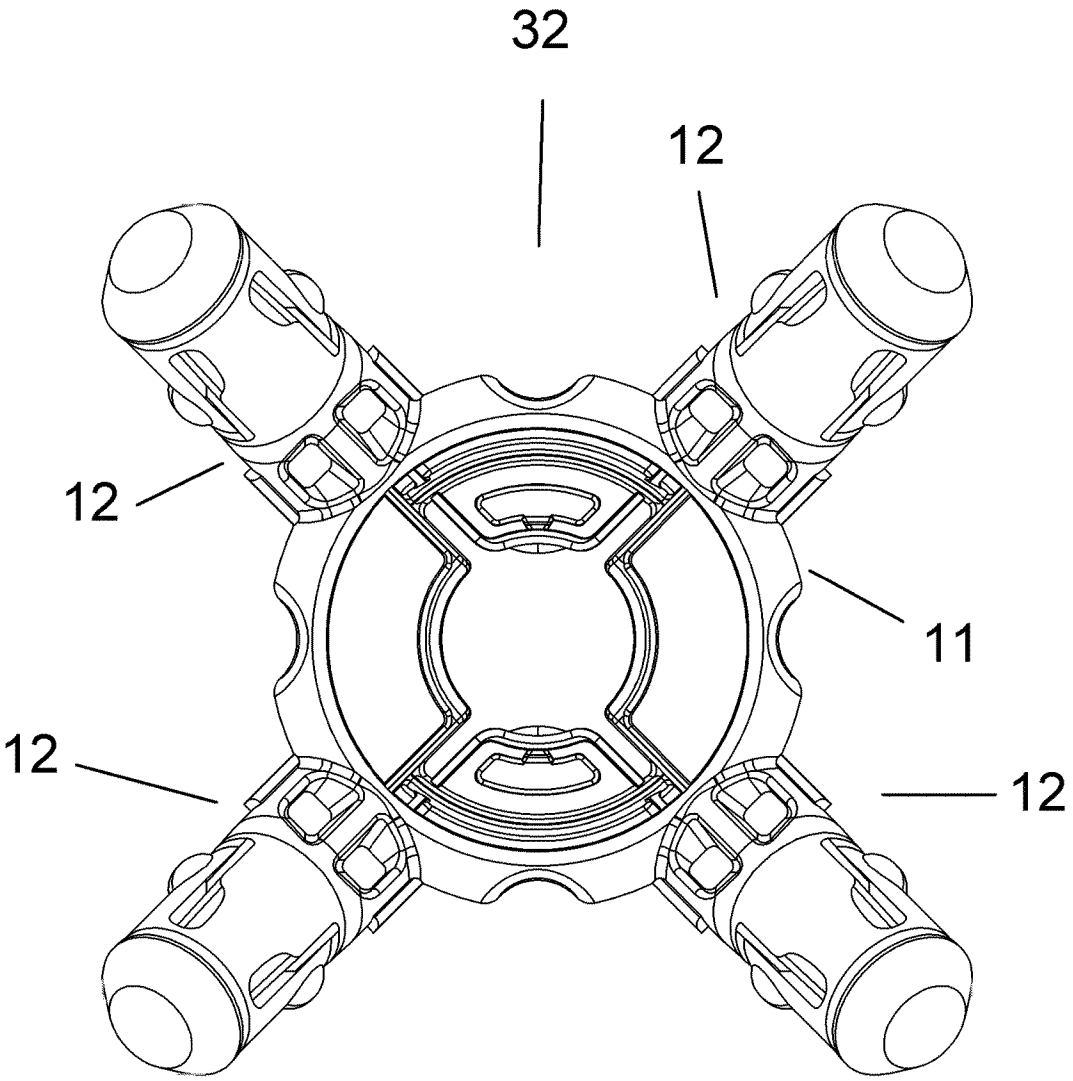
FIG. 21 is a top view of a seventh tube connector embodiment of the invention.

FIGS. 20 and 21 show a seventh tube connector 32, wherein four projecting members 12 are attached to a center portion 11 at substantially 90 degrees from each other. In addition, each of the projecting members 12 is tilted up from the plane of center portion 11 at substantially a 45 degree angle.

Figure 22:
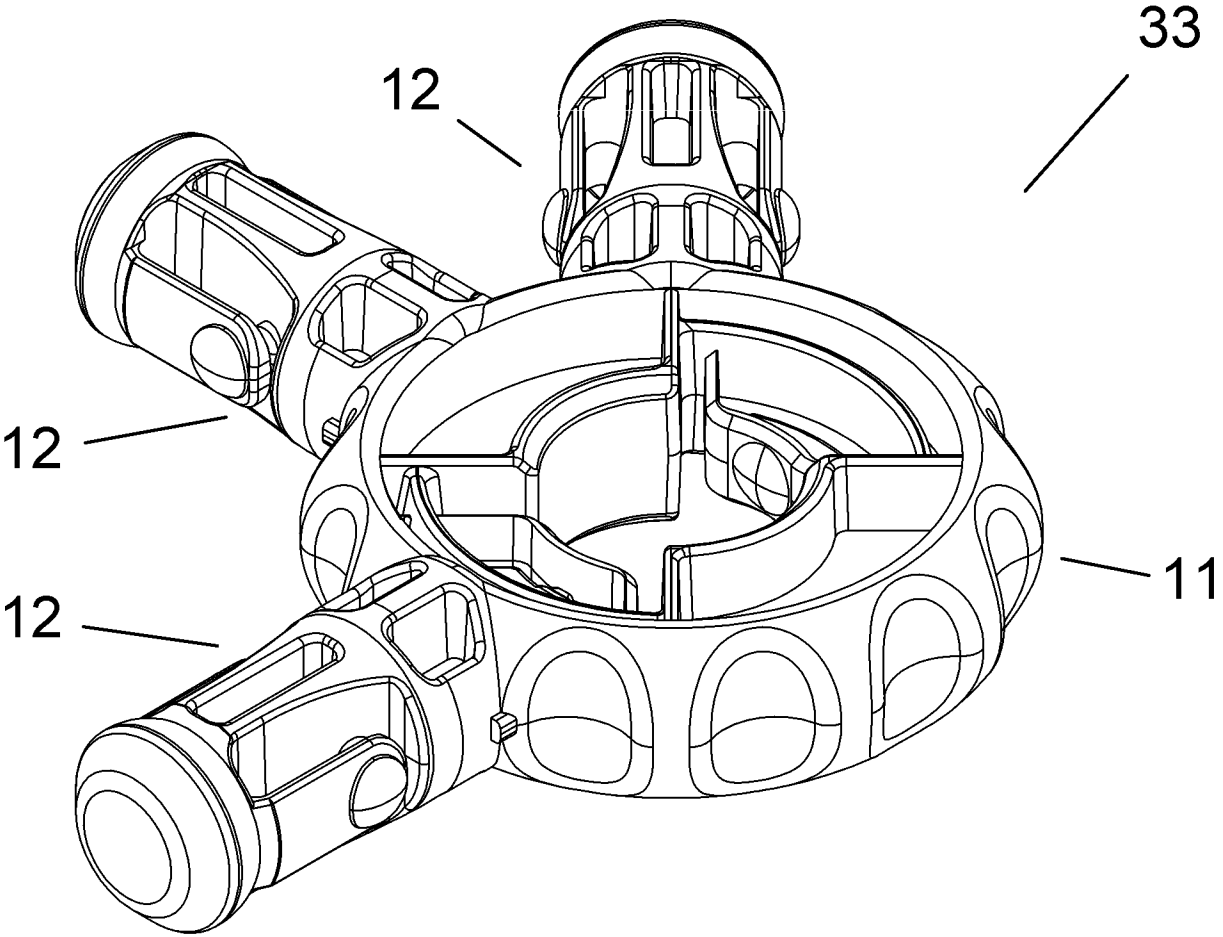
FIG. 22 is a perspective view of an eighth tube connector embodiment of the invention.
Figure 23:
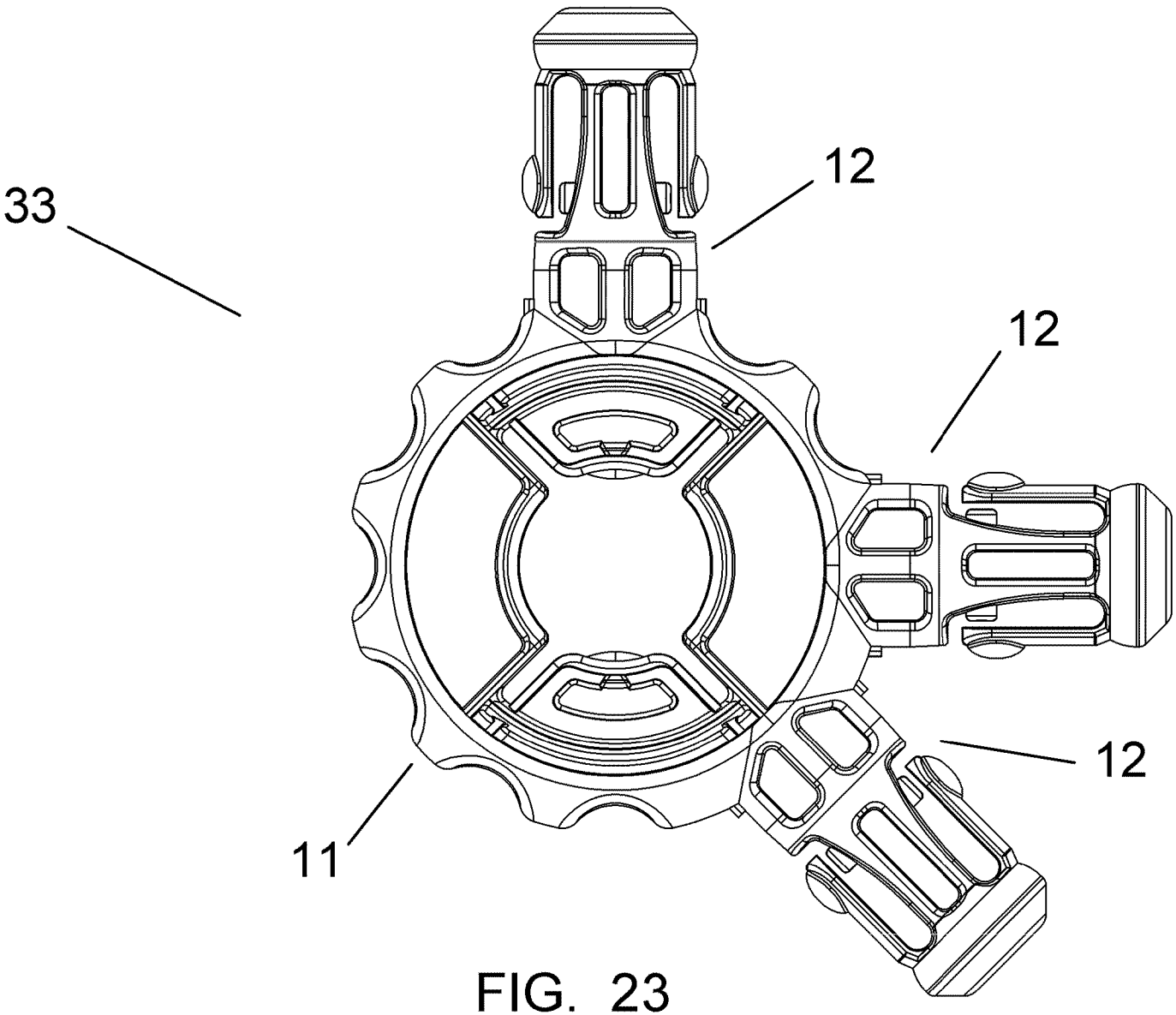
FIG. 23 is a top view of an eighth tube connector embodiment of the invention.

FIGS. 22 and 23 show an eighth tube connector 33, wherein two projecting members 12 are attached to a center portion 11 at substantially 90 degrees to each other. Another projecting member 12 is located not between the two projecting members, but instead is substantially 45 degrees from one of them. All the projecting members 12 lie in the same plane as center portion 11.

Figure 24:
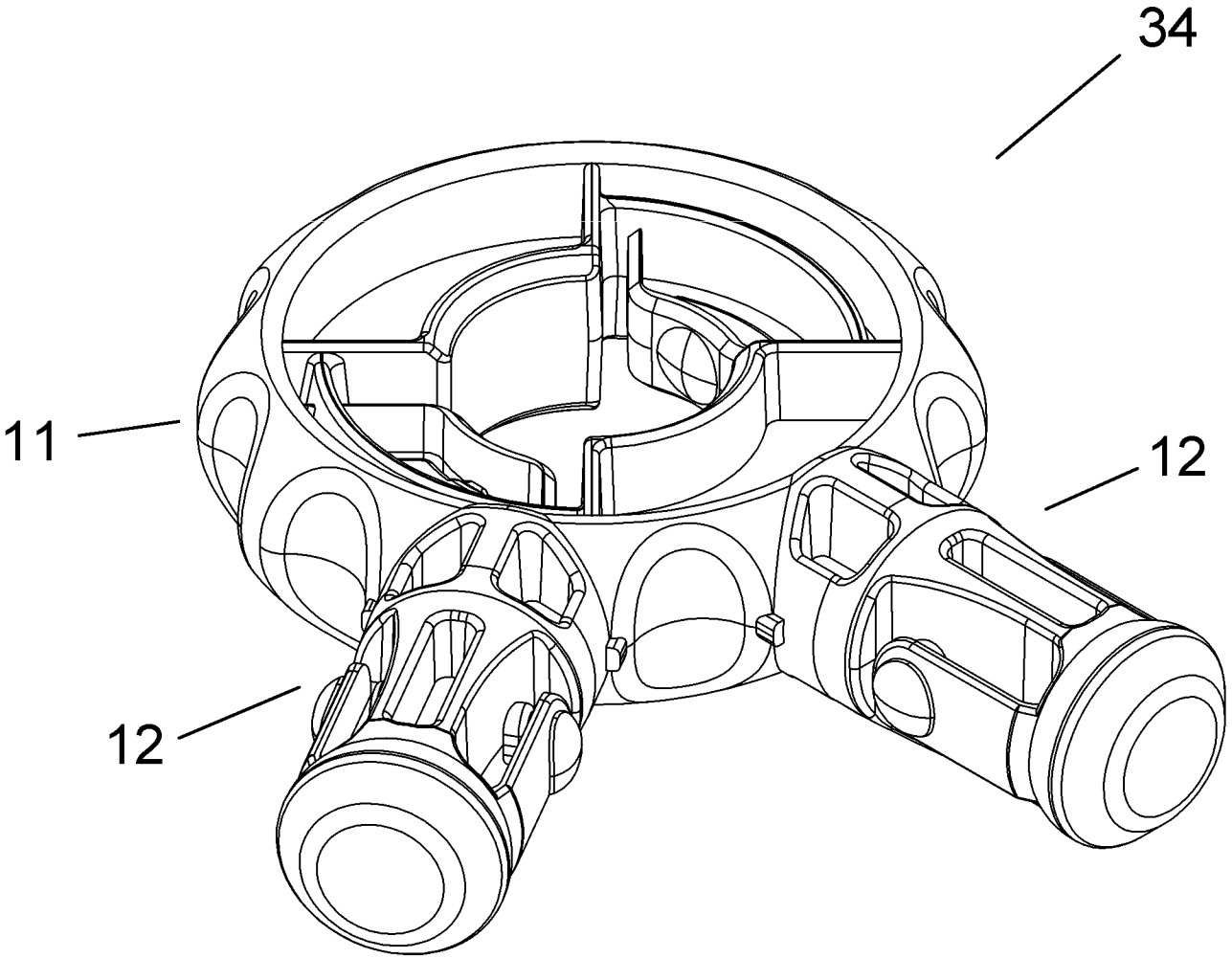
FIG. 24 is a perspective view of a ninth tube connector embodiment of the invention.
Figure 25:
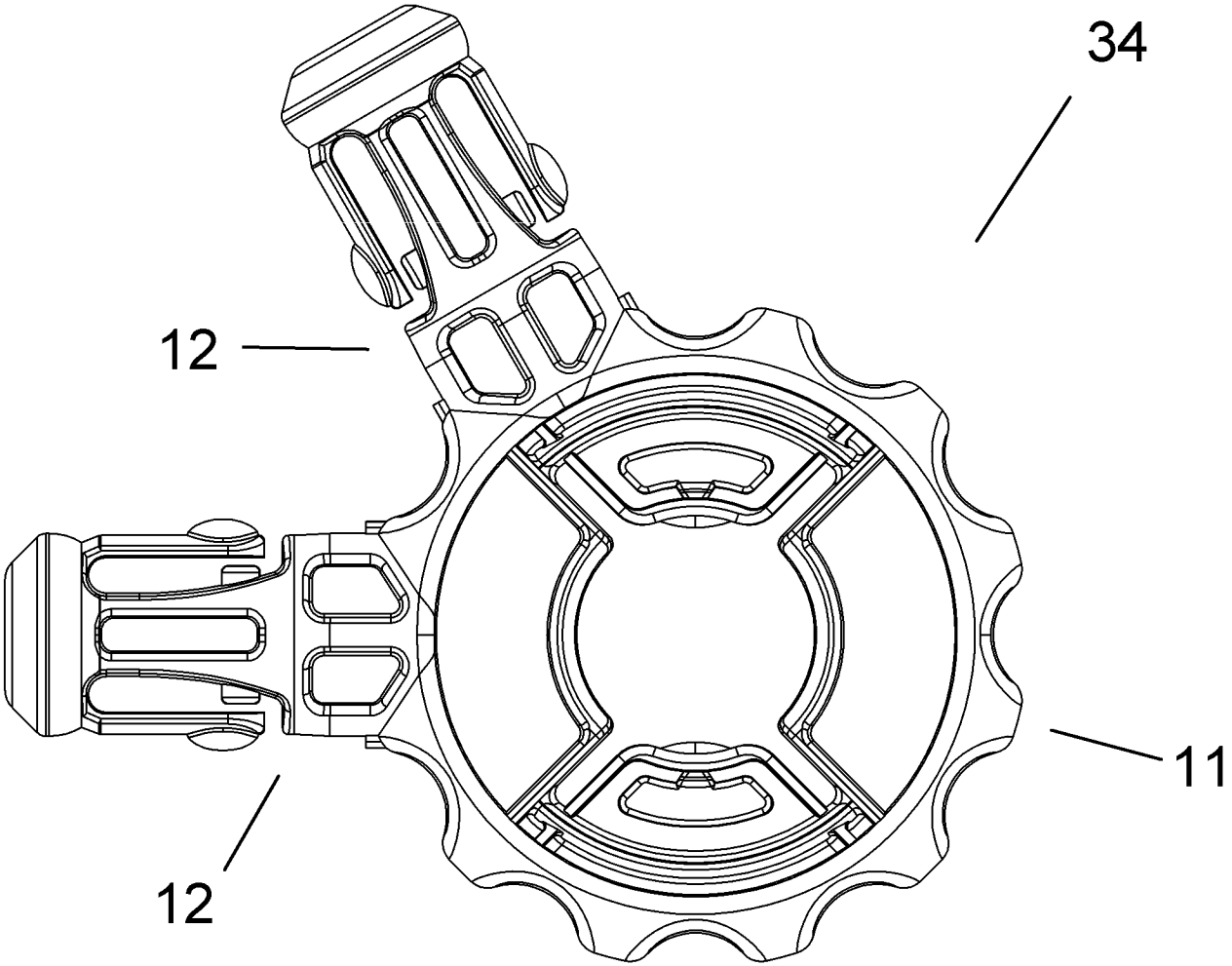
FIG. 25 is a top view of a ninth tube connector embodiment of the invention.

FIGS. 24 and 25 show a ninth tube connector 34, wherein two projecting members 12 are attached to a center portion 11 at substantially 60 degrees to each other. The projecting members 12 lie in the same plane as center portion 11.

Figure 26:
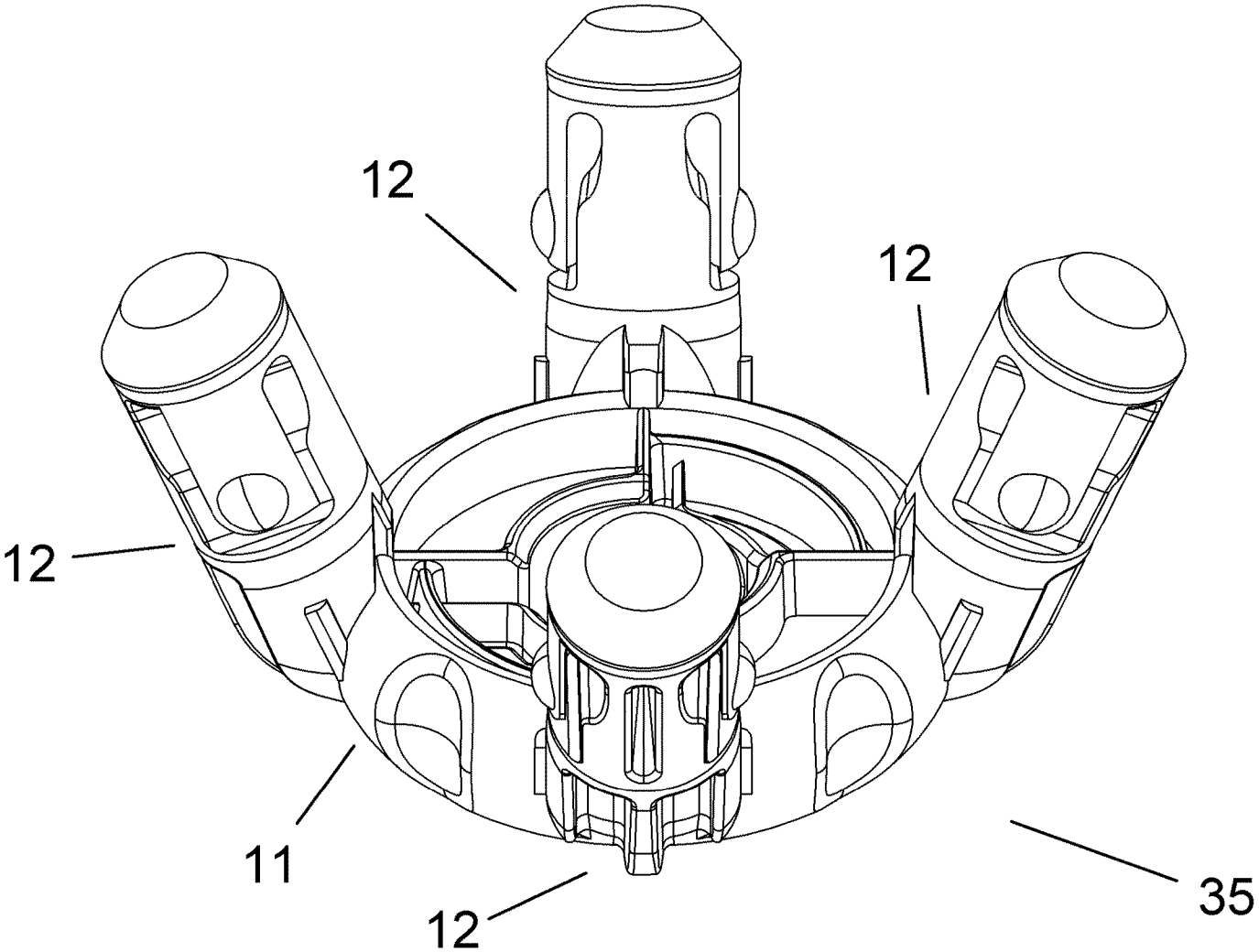
FIG. 26 is a perspective view of a tenth tube connector embodiment of the invention.
Figure 27:
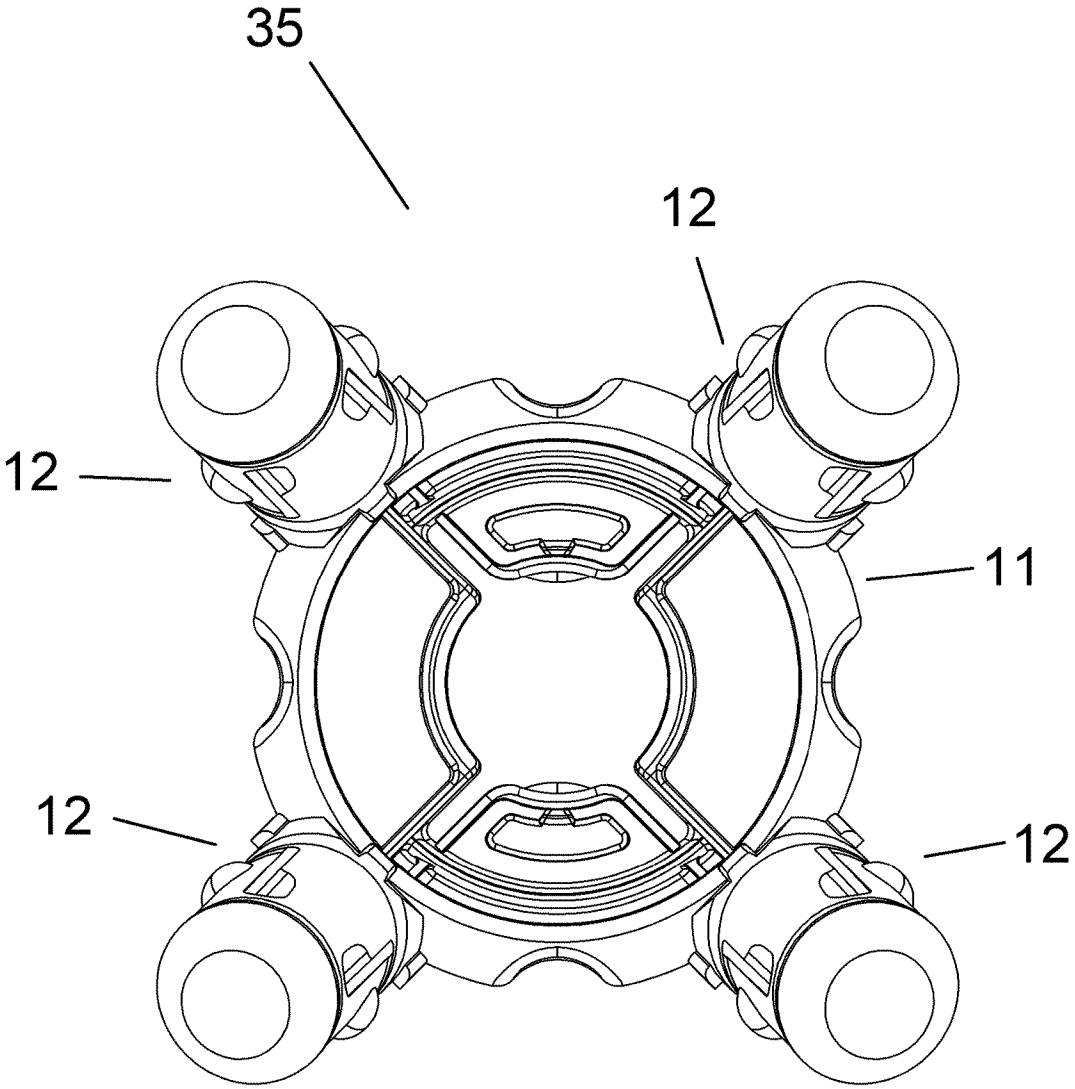
FIG. 27 is a top view of a tenth tube connector embodiment of the invention.

FIGS. 26 and 27 show a tenth tube connector 35, wherein four projecting members 12 are attached around a center portion 11 at substantially 90 degrees from each other. In addition, each of the projecting members 12 is tilted up from the plane of center portion 11 at substantially a 75 degree angle.

Figure 28:
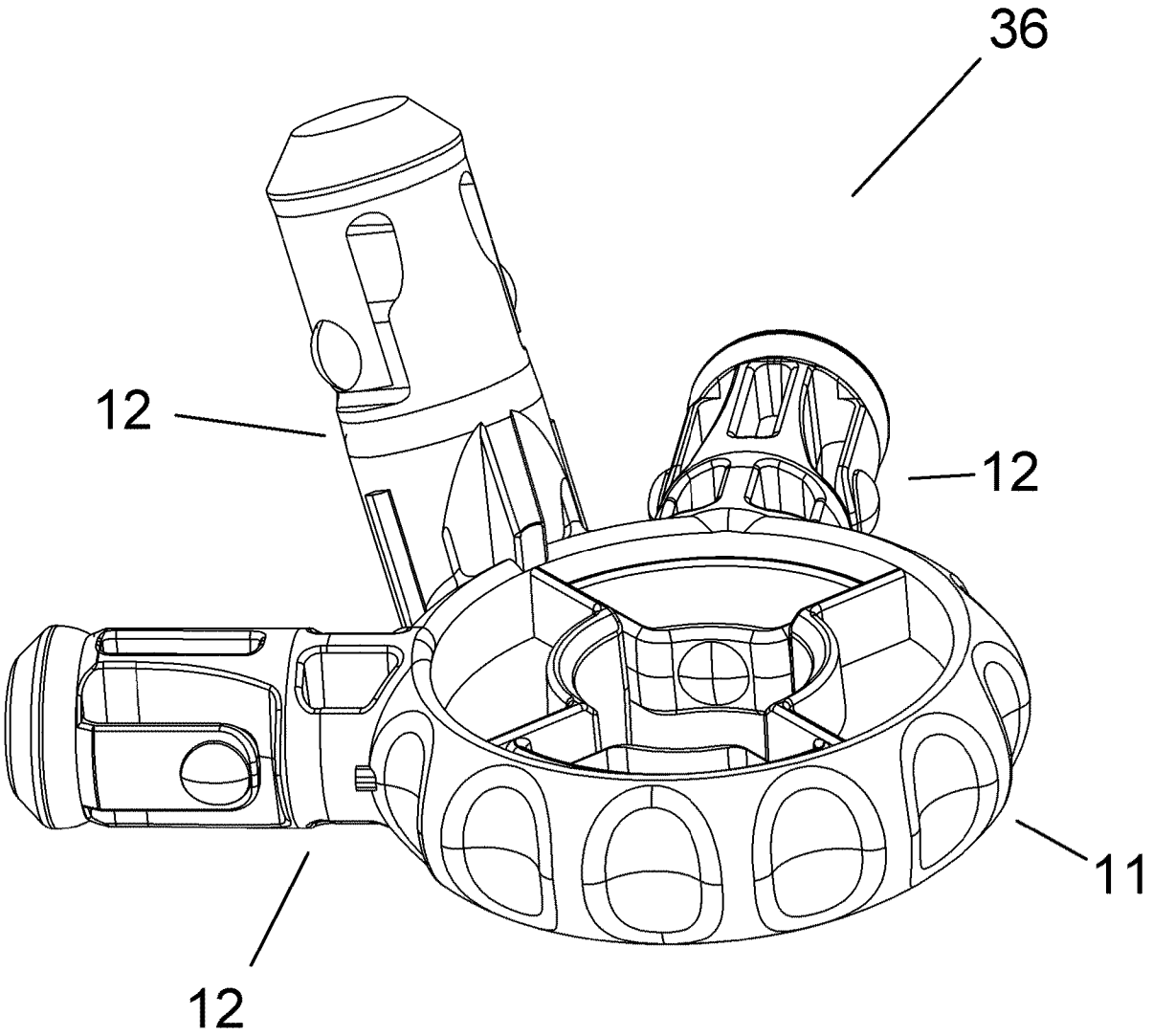
FIG. 28 is a perspective view of an eleventh tube connector embodiment of the invention.
Figure 29:
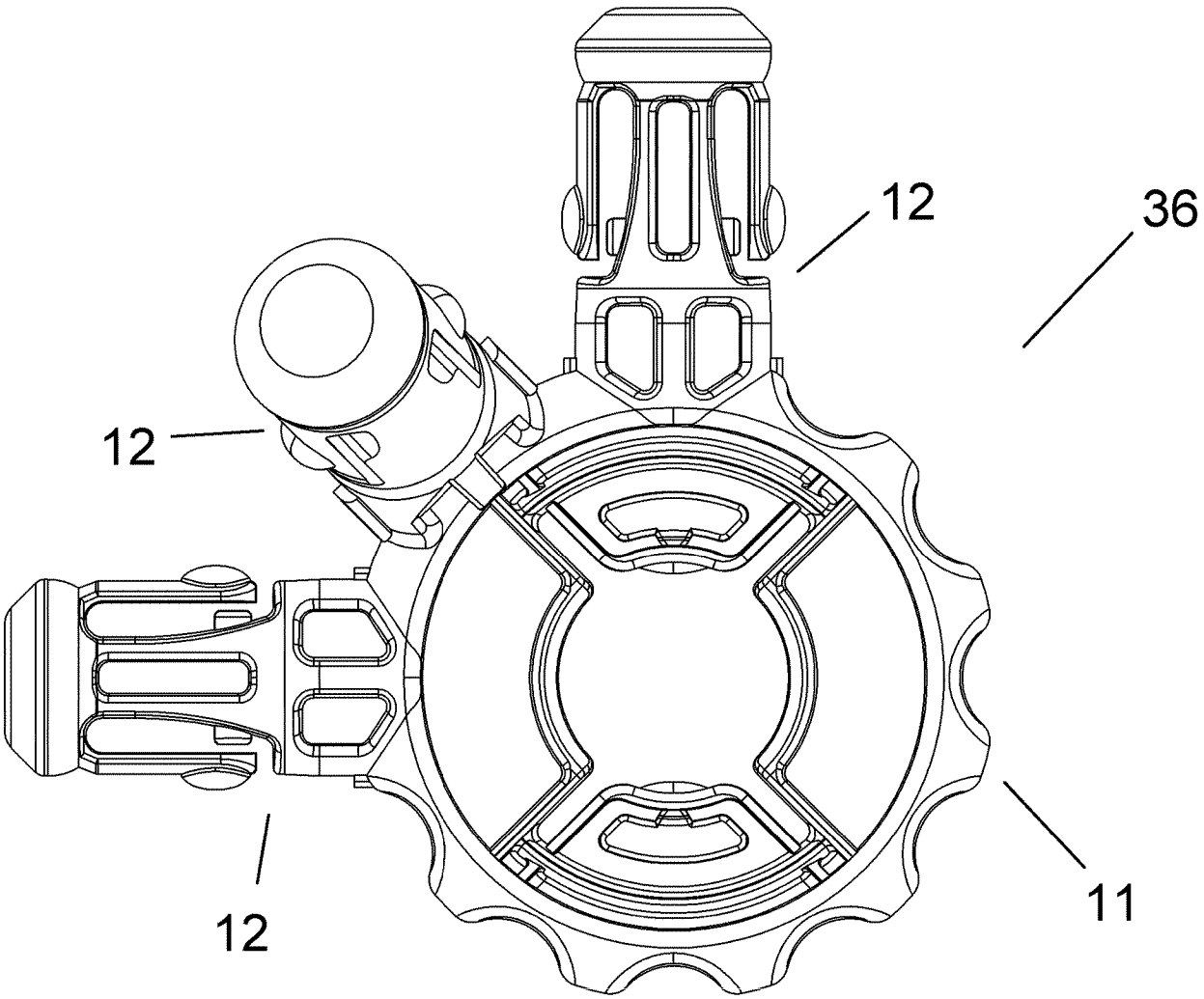
FIG. 29 is a top view of an eleventh tube connector embodiment of the invention.

FIGS. 28 and 29 show an eleventh tube connector 36, wherein two projecting members 12 are attached to a center portion 11 at substantially 90 degrees to each other. Another projecting member 12 is located between the two projecting members, substantially 45 degrees from each of them. The two projecting members 12 lie in the same plane as center portion 11, and the other projecting member 12 is tilted up from the plane of center portion 11 at substantially a 75 degree angle.

Figure 30:
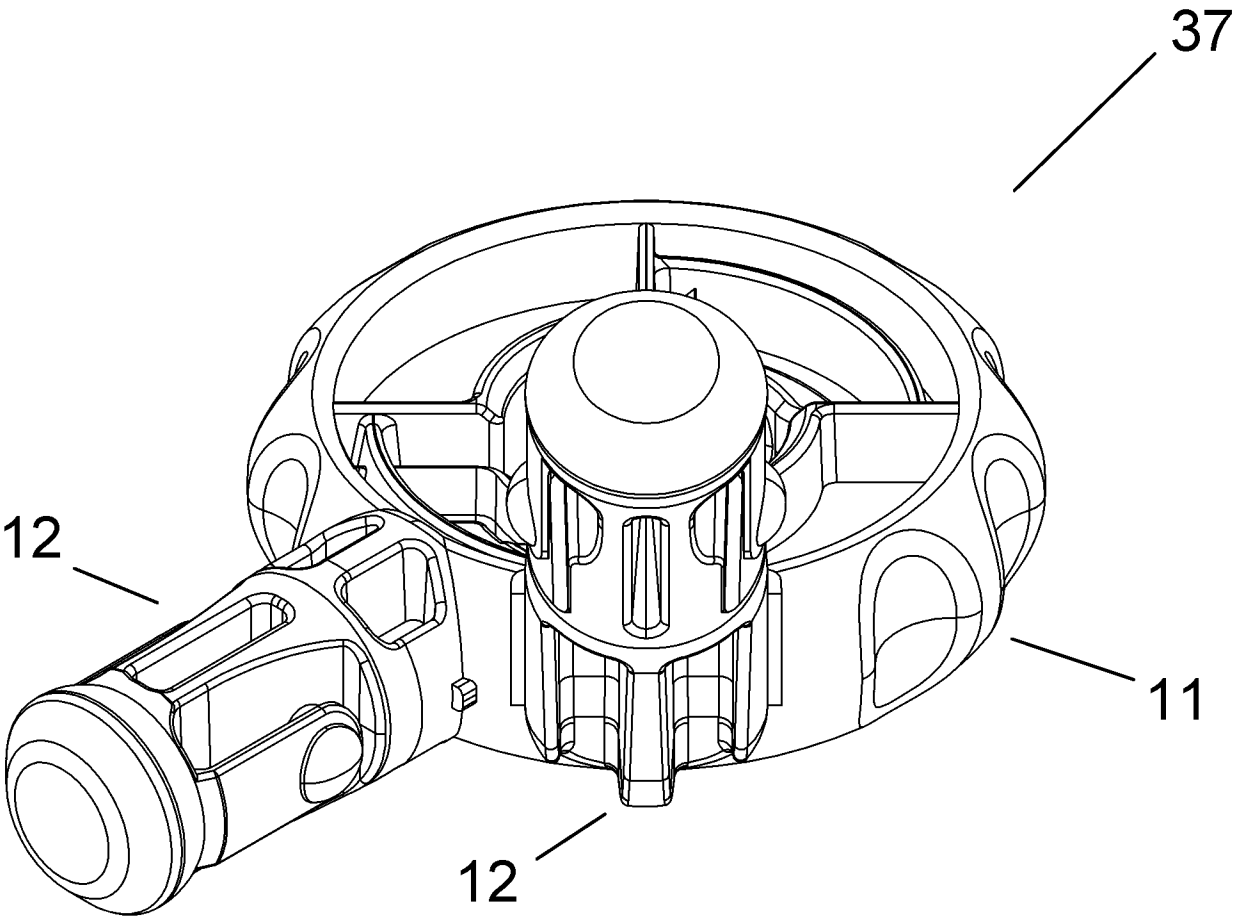
FIG. 30 is a perspective view of a twelfth tube connector embodiment of the invention.
Figure 31:
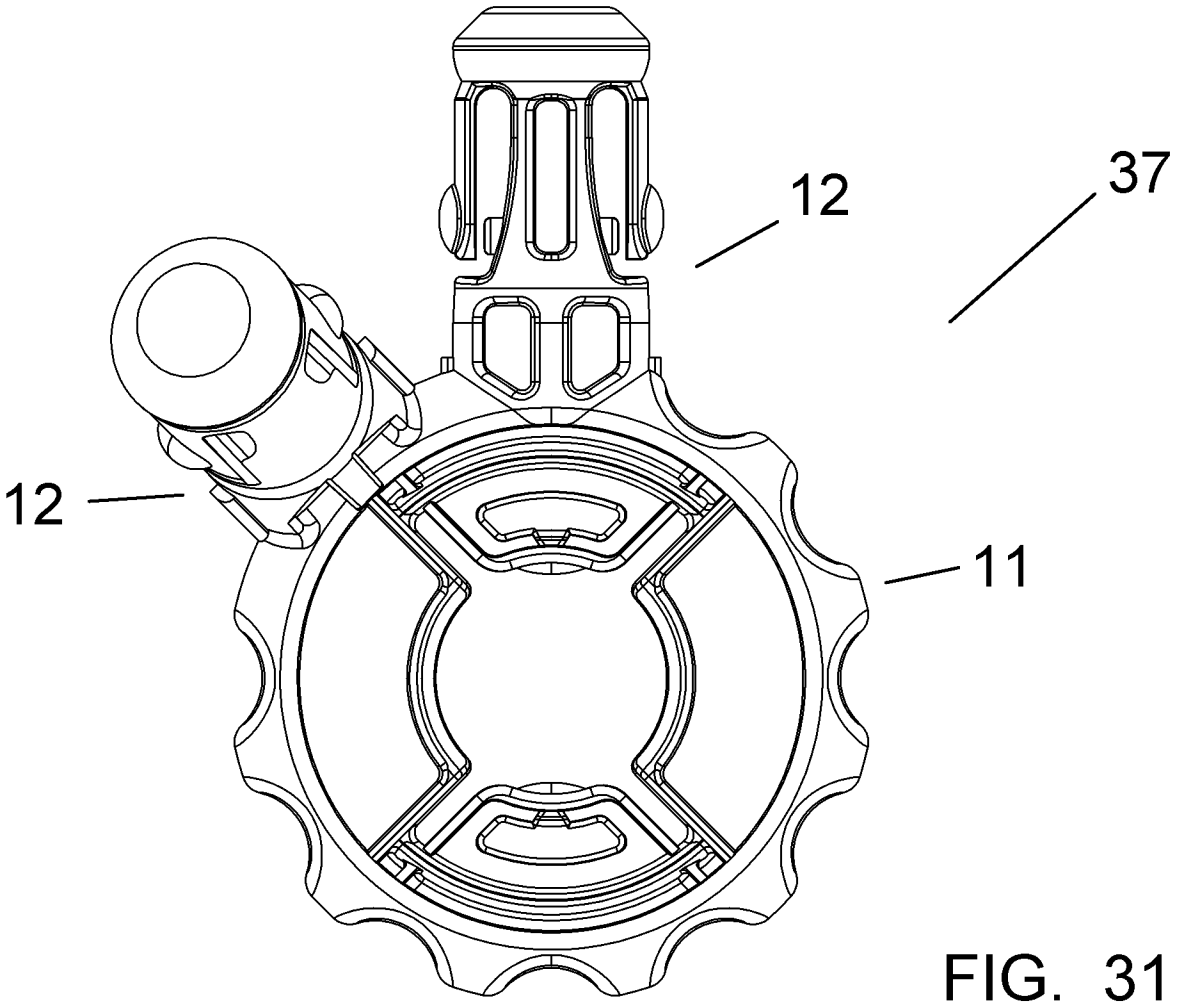
FIG. 31 is a top view of a twelfth tube connector embodiment of the invention.

FIGS. 30 and 31 show a twelfth tube connector 37, wherein two projecting members 12 are attached to a center portion 11 at substantially 45 degrees from each other. One projecting member 12 lies in the same plane as center portion 11, and the other projecting member 12 is tilted up from the plane of center portion 11 at substantially a 75 degree angle.

Figure 32:
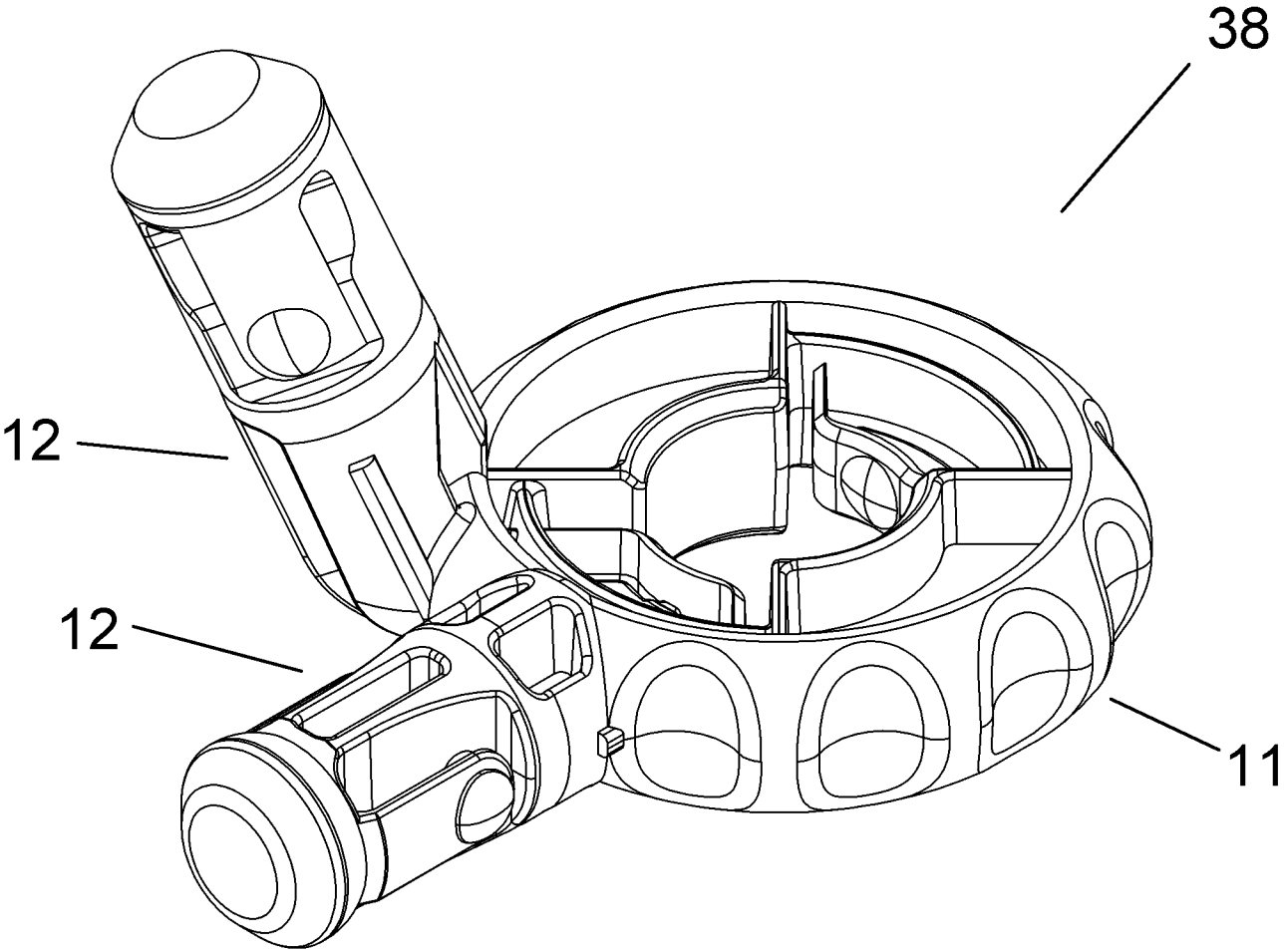
FIG. 32 is a perspective view of a thirteenth tube connector embodiment of the invention.
Figure 33:
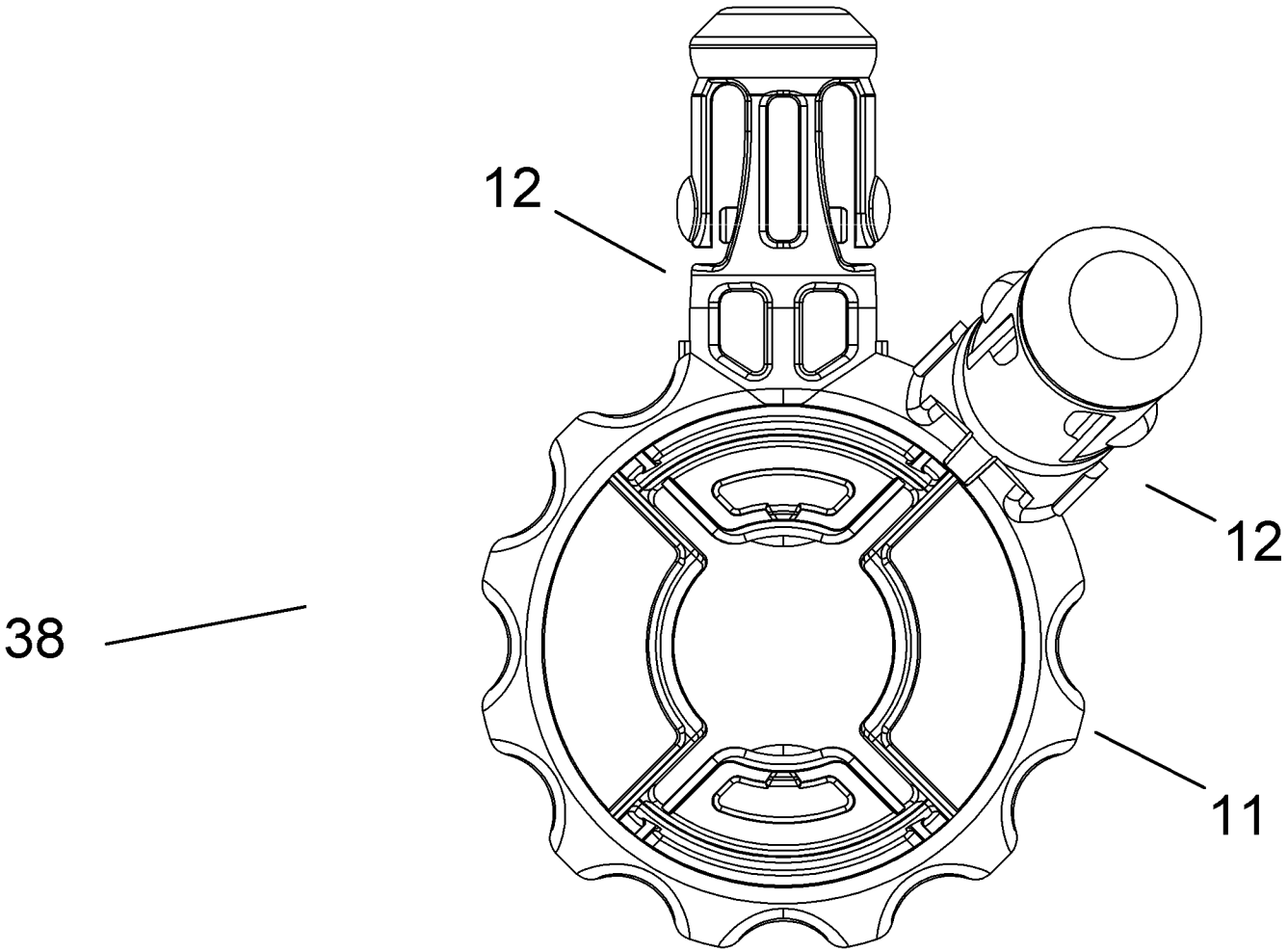
FIG. 33 is a top view of a thirteenth tube connector embodiment of the invention.

FIGS. 32 and 33 show a thirteenth tube connector 38, wherein two projecting members 12 are attached to a center portion 11 at substantially 45 degrees from each other. One projecting member 12 lies in the same plane as center portion 11, and the other projecting member 12 is tilted up from the plane of center portion 11 at substantially a 75 degree angle. This tube connector is similar to twelfth tube connector 37, except that the tilted-up projecting member is on the other side of the non-tilted-up projecting member. Said another way, when the non-tilted-up projecting member is at "zero degrees" as seen in FIGS. 31 and 33, the tilted-up projecting member is 45 degrees to the right in thirteenth tube connector 38, rather than 45 degrees to the left as in twelfth tube connector 37.

Figure 34:
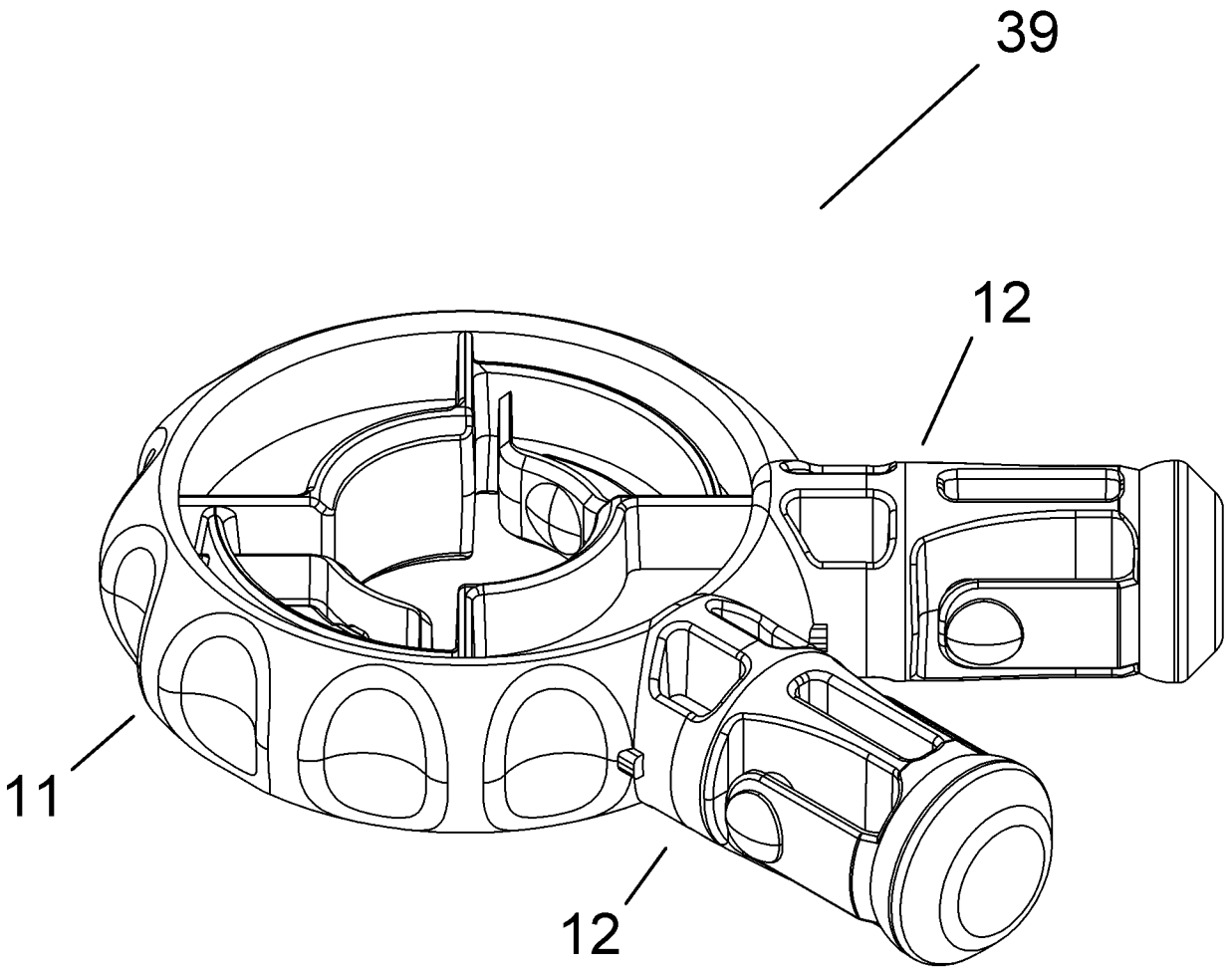
FIG. 34 is a perspective view of a fourteenth tube connector embodiment of the invention.
Figure 35:
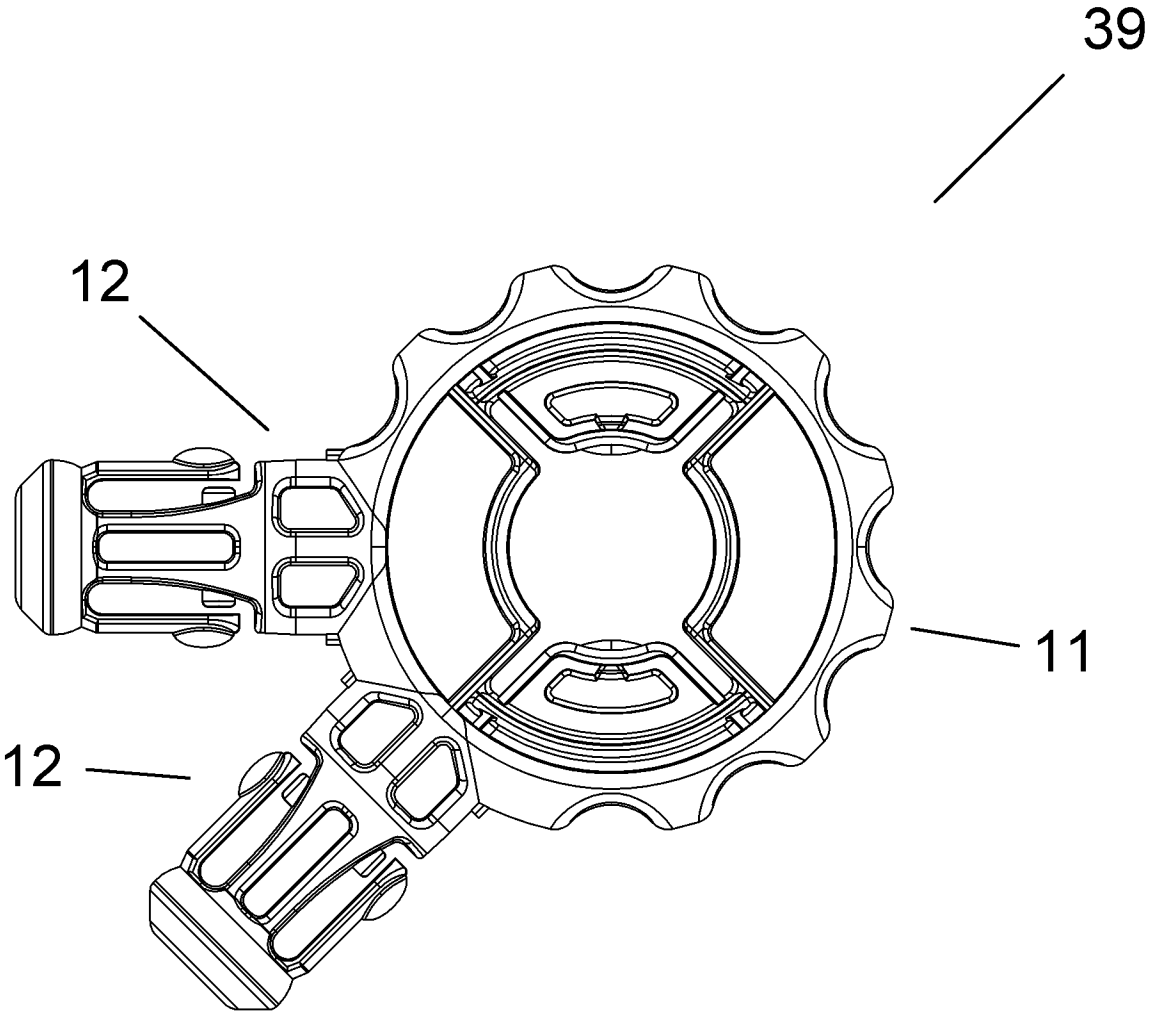
FIG. 35 is a top view of a fourteenth tube connector embodiment of the invention.

FIGS. 34 and 35 show a fourteenth tube connector 39, wherein two projecting members 12 are attached to a center portion 11 at substantially 45 degrees to each other. The projecting members 12 lie in the same plane as center portion 11.

Figure 36:
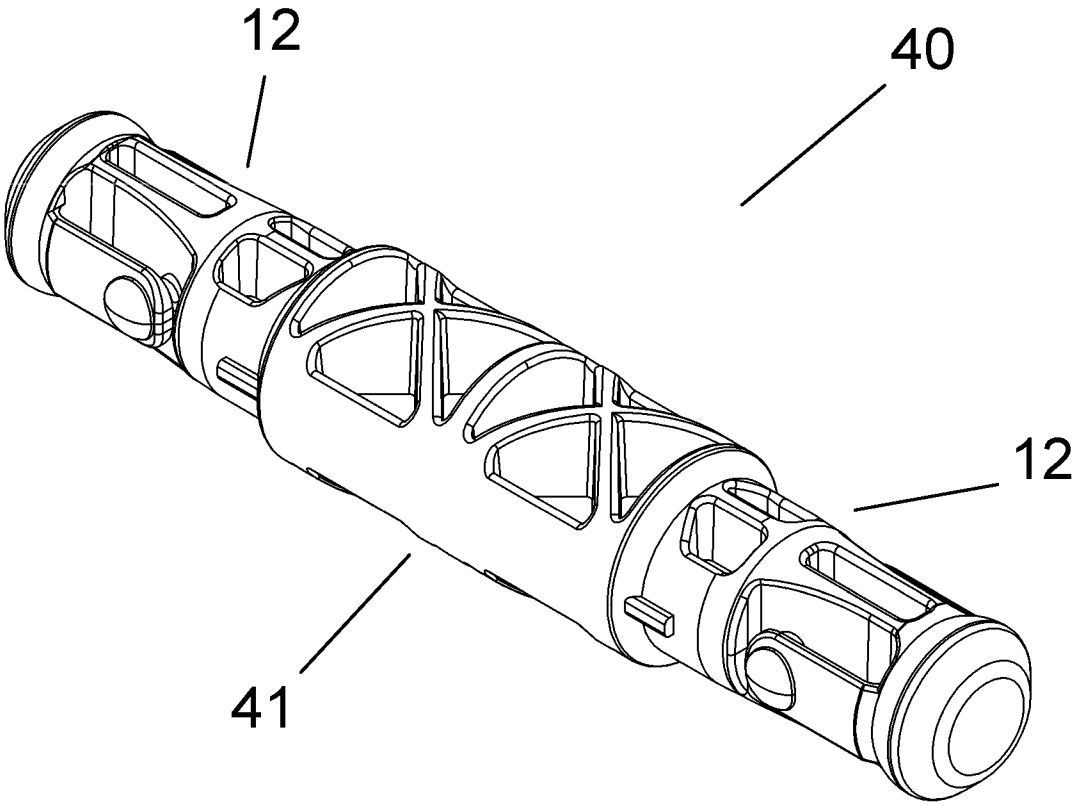
FIG. 36 is a perspective view of a fifteenth tube connector embodiment of the invention.
Figure 37:
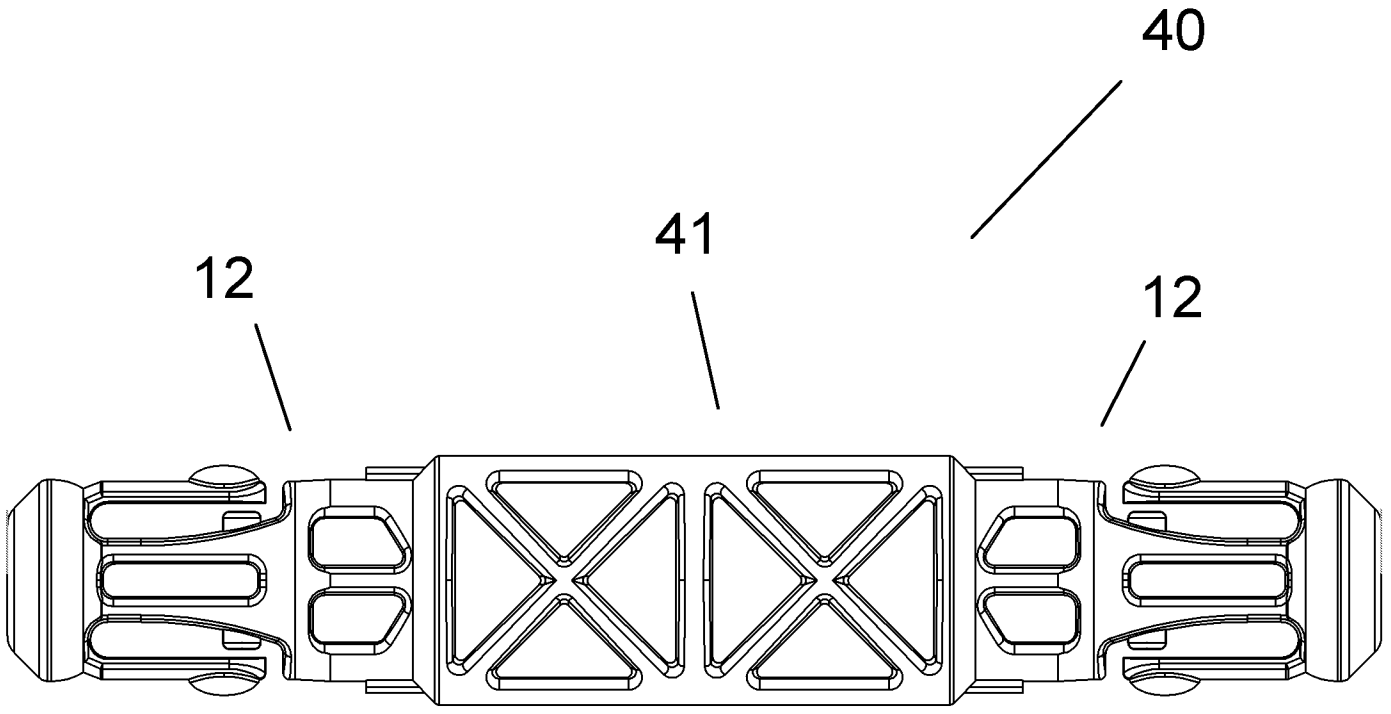
FIG. 37 is a top view of a fifteenth tube connector embodiment of the invention.

FIGS. 36 and 37 show a fifteenth tube connector 40, wherein two projecting members 12 are attached to a straight center portion 41 at substantially 180 degrees to each other. Fifteenth tube connector 40 is used to attach two tubes together end-to-end, such that the attached tubes lie in the same plane. Except for having a straight center portion rather than a center portion through which a tube can be inserted, the projecting member components of fifteenth tube connector 40 are the same as the projecting member components of tube connector 10 and the other tube connectors discussed above. Operationally, the manner in which a tube is connected to and disconnected from the projecting member is the same as with tube connector 10 and the other tube connectors.

Figure 38:
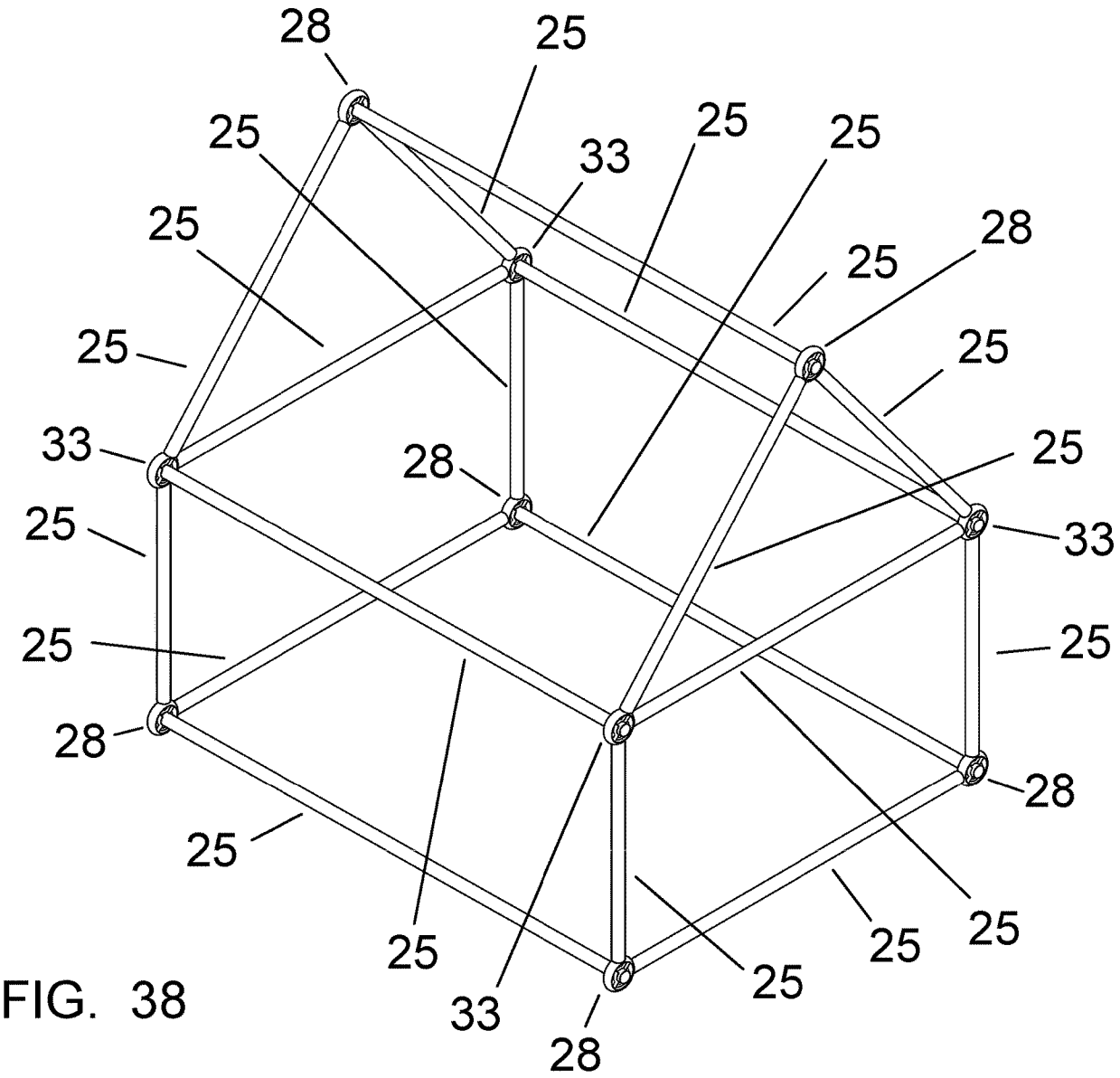
FIG. 38 is a perspective view of a play structure assembled using various tube connectors and tubes of the invention.

FIG. 38 illustrates the play structure system of the invention, wherein multiple tubes are connected together using multiple tube connectors, to form a play fort. Tubes 25 of various lengths form the frame of a play structure 42. For simplicity, tube openings 26 are not shown in this figure—but it can be appreciated that the tube openings are the same as those already shown in FIG. 3, FIG. 6, et al. The tubes in this particular play structure are connected together using third tube connectors 28 and eighth tube connectors 33, as discussed below:

Third tube connectors 28 are used at the bottom corners of play structure 42. One tube 25 is inserted into center opening 13, and a tube 25 fits over each of the two projecting members 12 that are spaced substantially 90 degrees apart. It should be noted that the orientation of third tube connector 28 can be different than the orientation shown in FIG. 37—i.e., any one of the three tubes which meet at the bottom corner can be inserted into the center opening of the tube connector, with the other two tubes fitting over the two projecting members that are spaced substantially 90 degrees apart.

An eighth tube connector 33 is used at each top corner of play structure 42. One tube 25 is inserted into center opening 13; a tube 25 fits over each of the two projecting members 12 that are spaced substantially 90 degrees apart; and a tube 25 also fits over the projecting member 12 that is spaced substantially 45 degrees apart from one of the other two projecting members 12.

A third tube connector 28 is used at each end of the roof peak of play structure 42. One tube 25 is inserted into center opening 13, and a tube 25 fits over each of the two projecting members 12 that are spaced substantially 90 degrees apart. And as with the connectors at the bottom corner, the orientation of third tube connector 28 at the roof peak can be different than the orientation shown—i.e., any one of the three tubes which meet at the roof peak can be inserted into the center opening of the tube connector, with the other two tubes fitting over the two projecting members that are spaced substantially 90 degrees apart.

It should be understood that various different tube connectors of the invention and tubes of various lengths can be used to build any number of different play structures. In addition, solid or flexible panels or other coverings can be attached to the tubes and tube connectors of the invention, in order to entirely or partially cover the frame of play structure 42.

While the above descriptions contain many specificities, these shall not be construed as limitations on the scope of the invention, but rather as exemplifications of embodiments thereof. Many other variations are possible without departing from the spirit of the invention.

Accordingly, the scope of the invention should be determined not by the embodiments illustrated, but by the appended claims and their legal equivalents.

What is claimed is:

1. A play structure tube connector, comprising:

a center portion, the center portion comprising a center opening therein;

a projecting member extending from the center portion, the projecting member comprising a center portion proximate end and a noncenter portion proximate end;

the projecting member comprising two flexing tabs located on opposite sides of the projecting member, each of the two flexing tabs comprising a fixed end toward the non-center portion proximate end of the projecting member and a flexing end toward the center portion proximate end of the projecting member, wherein the center portion is adapted to admit a first tube into the center opening, and the projecting member is adapted to fit inside a second tube, thereby connecting the first tube and the second tube together, and wherein a center flexing member is located on the center portion, and a projection is located on the center flexing member, the projection being adapted to fit into an opening in the first tube in order to secure the first tube to the center portion.

2. The play structure tube connector of claim 1, wherein a plurality of projecting members extend from the center portion.

3. The play structure tube connector of claim 1, wherein a projection is located on the flexing end of each of the two flexing tabs, and the projections are adapted to fit into an opening in the second tube in order to secure the second tube to the projecting member.

4. The play structure tube connector of claim 1, wherein two tab stops are located on the projecting member under the flexing end of each of the two flexing tabs respectively, and each of the tab stops is adapted to limit the motion of the respective flexing tab.

5. The play structure tube connector of claim 1, wherein at least one abutment is located at the center portion proximate end of the projecting member, and the abutment is adapted to limit the motion of the second tube toward the center portion.

6. The play structure tube connector of claim 1, wherein a bevel is located at the non-center portion proximate end of the projecting member.

7. The play structure tube connector of claim 1, wherein the projecting member lies in the same plane as the center portion.

8. The play structure tube connector of claim 1, wherein the projecting member lies in a different plane from the center portion.

9. The play structure tube connector of claim 1, wherein the projecting member comprises a circular tip disposed at the noncenter portion proximate end, and the circular tip has substantially the same circumference as an inner circumference of the second tube.

10. The play structure tube connector of claim 1, wherein two abutments are located on opposite sides of the center portion-proximate end of the projecting member, and the abutments are configured to provide stable resting surfaces for an end of the second tube.

11. The play structure tube connector of claim 1, wherein the center flexing member comprises an open space surrounding a center tab, thereby enabling the center flexing member to move towards and away from the center opening.

12. The play structure tube connector of claim 1, further comprising a second center flexing member located opposite the center flexing member on the center portion, and a second projection located on the second center flexing member, the second projection being adapted to fit into a second opening in the first tube in order to secure the first tube to the center portion.

13. The play structure tube connector of claim 1, wherein the center flexing member is capable of moving towards and away from the center opening.

14. A play structure system, comprising:

a plurality of tube connectors, each tube connector comprising a center portion;

a projecting member extending from the center portion, the projecting member comprising a center portion proximate end and a non-center portion proximate end;

the projecting member comprising two flexing tabs located on opposite sides of the projecting member, each of the two flexing tabs comprising a fixed end toward the non-center portion proximate end of the projecting member and a flexing end toward the center portion proximate end of the projecting member;

a plurality of tubes that fit over the projecting members of the plurality of tube connectors, thereby connecting the plurality of tubes together into a play structure, wherein each tube connector has a center opening in the center portion thereof, and each of the plurality of tubes is adapted to fit into the center opening, wherein a center flexing member is located on the center portion of each tube connector, and a projection is located on each center flexing member, the projection being adapted to fit into an opening disposed in each of the plurality of tubes in order to secure a respective one of the plurality of tubes to the center portion.

15. The play structure system of claim 14, wherein a plurality of projecting members extend from the center portion.

16. The play structure system of claim 14, wherein a projection is located on the flexing end of each of the two flexing tabs, and the projections are adapted to fit into an opening in one of the plurality of tubes in order to secure the tube to the projecting member.

17. The play structure system of claim 14, wherein more than one length is present in the plurality of tubes.

18. The play structure tube connector of claim 14, wherein the projecting member lies in the same plane as the center portion.

19. The play structure tube connector of claim 14, wherein the projecting member lies in a different plane from the plane of the center portion.

20. A play structure tube connector, comprising:

a center portion;

two projecting members extending from the center portion, each projecting member comprising a center portion proximate end and a non-center portion proximate end;

each projecting member comprising two flexing tabs located on opposite sides of the projecting member, each of the flexing tabs comprising a fixed end toward the non-center portion proximate end of the projecting member and a flexing end toward the center portion proximate end of the projecting member;

wherein each projecting member is adapted to fit inside a tube, thereby connecting the tubes together, wherein two tab stops are located on the projecting member under the flexing end of each of the two flexing tabs respectively, each of the tab stops projects from a main body of the respective projecting member, and each of the tab stops is adapted to limit the motion of the respective flexing tab.

* * * * *